US010866535B2

(12) United States Patent
Maeda

(10) Patent No.: US 10,866,535 B2
(45) Date of Patent: Dec. 15, 2020

(54) IMAGE FORMING APPARATUS

(71) Applicant: CANON KABUSHIKI KAISHA, Tokyo (JP)

(72) Inventor: Yuichiro Maeda, Kashiwa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/426,640

(22) Filed: May 30, 2019

(65) Prior Publication Data

US 2019/0377278 A1 Dec. 12, 2019

(30) Foreign Application Priority Data

Jun. 6, 2018 (JP) ..... 2018-108719

(51) Int. Cl.
*G03G 15/043* (2006.01)

(52) U.S. Cl.
CPC ..... *G03G 15/043* (2013.01)

(58) Field of Classification Search
CPC combination set(s) only.
See application file for complete search history.

(56) References Cited

U.S. PATENT DOCUMENTS

2017/0357201 A1 12/2017 Maeda
2018/0259894 A1* 9/2018 Takahashi ..... G03G 15/553
2018/0373176 A1* 12/2018 Tanaka ..... G03G 15/5054

FOREIGN PATENT DOCUMENTS

JP 2017-219764 12/2017

* cited by examiner

*Primary Examiner* — Helen Zong
(74) *Attorney, Agent, or Firm* — Venable LLP

(57) ABSTRACT

The image forming apparatus includes: a plurality of photosensitive drums arranged with an interval; a light scanning device, which includes a plurality of semiconductor lasers corresponding to the plurality of photosensitive drums on a one-to-one basis, and is configured to form a latent image on the photosensitive drum; an exposure control portion configured to generate a drive signal for causing the semiconductor laser to turn on or off the light based on image data; and a CPU configured to output a parameter for generating the drive signal to the exposure control portion, in which the CPU outputs the parameter to the exposure control portion at a transfer speed that is set so that the outputting of the parameter corresponding to the plurality of semiconductor lasers is completed within a time period calculated from the interval and rotation speeds of the photosensitive drums.

8 Claims, 11 Drawing Sheets

IMAGE FORMING APPARATUS

BACKGROUND OF THE INVENTION

Field of the Invention

The present invention relates to an image forming apparatus, and more particularly, to communication between control devices used inside an image forming apparatus, for example, between a CPU configured to perform overall control and an application specific integrated circuit (ASIC) configured to perform light emission control of an exposure device.

Description of the Related Art

There is known an electrophotographic developing as an image recording scheme to be used for a copying machine or other such image forming apparatus. In the image forming apparatus that employs the electrophotographic developing, light blinked based on image data input from an original reading apparatus, a computer, or other such external apparatus is emitted from an exposure device to form a latent image on a photoconductor, and the latent image is developed with a coloring material (toner). The image data input to the image forming apparatus is subjected to a plurality of kinds of image processing, and is then converted into a PWM signal for blinking the light from the exposure device. FIG. 8 is an example of control blocks of the image forming apparatus that employs the electrophotographic developing, which are configured to convert the image data input to the image forming apparatus into the PWM signal for blinking the light from the exposure device, and the image forming apparatus includes an overall control portion 1600 configured to administer an overall operation of the image forming apparatus and an exposure control portion 1620 configured to control the exposure device. A communication portion 1605 of the overall control portion 1600 and a communication portion 1625 of the exposure control portion 1620 are connected to each other through a serial communication line. An image correction portion 1630 includes a register configured to store a parameter for performing image correction. A CPU 1601 calculates a parameter for performing correction in accordance with characteristics of the exposure device, and stores the parameter in the register included in the image correction portion 1630. FIG. 9A is a sectional view for illustrating a main portion of an image forming apparatus of a tandem type. In the image forming apparatus of the tandem type, photosensitive drums 1701 are arranged with a predetermined interval 1*d*. Therefore, as illustrated in FIG. 9B, latent images of M, C, and K are formed while timings are shifted by times Td1, Td2, and Td3, respectively, based on (in synchronization with) a reference timing signal.

In recent years, it has also become possible to insert a sheet different from a sheet used for main text into the image forming apparatus as a partition sheet during continuous printing. When the partition sheet differs from the sheet used for main text in size, the CPU 1601 is required to change a parameter of each register. In such a case, the parameter is changed in a sheet gap segment, in which processing is not performed on any one of the pages. The register of the image correction portion 1630 has the parameter changed in synchronization with such a timing to form a latent image in an image forming apparatus main body as illustrated in FIG. 9D. In recent years, the number of registers tends to further increase due to an increase in demand for higher image quality, and at the same time, the sheet gap segment tends to become shorter for improvement in productivity of the image forming apparatus (see, for example, Japanese Patent Application Laid-Open No. 2017-219764). Under such circumstances, it is sometimes impossible to send all pieces of data of the registers that are required to be changed within the sheet gap segment. In such a case, register data is stored in advance in a RAM 1622 by the CPU 1601 before the sheet gap segment. Then, when the sheet gap segment is reached, DMA 1621 transfers the register data stored in the RAM 1622 to the register. In general, a latent image formation segment is sufficiently longer than the sheet gap segment, and data transfer from a RAM to the register by DMA is also faster than a transfer speed of serial communication. Therefore, by employing the above-mentioned scheme, it is possible to reflect more pieces of register data in the registers even in a short sheet gap segment. Detailed descriptions relating to FIG. 8 and FIG. 9A to FIG. 9D are given later.

In order to transmit more pieces of register data in a short sheet gap segment through serial communication, it is conceivable to increase the transfer speed. However, in general, when the transfer speed is increased, it is required to take measures against noise. That is, it is desired to set the transfer speed of the serial communication as low as possible in order to suppress the cost to a low level.

However, when the transfer speed is set low, the following problems occur. In this case, in each of FIG. 10A to FIG. 10D, it is illustrated how latent images of a page n−1 and a page "n" that is different in size from (smaller in size than) that of the page n−1 are formed in each color. In such a case, register data for the page "n" is ideally transmitted in advance in synchronization with a reference timing signal for the page n−1 as illustrated in FIG. 10B. However, as illustrated in FIG. 10B, overlapping segments A, B, and C occur between transmission segments for the respective colors. Only one serial communication line is provided, and hence in actuality, the pieces of register data on the respective colors are transmitted in succession as illustrated in FIG. 10D. As a result, as illustrated in FIG. 10C and FIG. 10D, latent image formation is started before register setting for the page "n" is completed. At this time, the register whose setting is yet to be completed still holds the register data for the previous page, to thereby fail to obtain a desired image and form an unsatisfactory image.

In order to avoid the above-mentioned situation, it is required to set the transfer speed so that transmission of all pieces of register data required for forming latent images of the respective colors is finished at least within a time period shorter than an inter-drum movement time period Td. However, even when the transfer speed is set so that the transmission of all the pieces of register data required for forming the latent images of the respective colors is finished within the time period shorter than the inter-drum movement time period Td, the following problem further occurs. In FIG. 11A, it is illustrated how the page "n" during the continuous printing is different in size from (smaller in size than) those of the preceding page n−1 and the succeeding page n+1. As illustrated in FIG. 11B, there are overlapping segments A, B, and C between transmission segments of pieces of register data on the C color and the K color for the page "n" and transmission segments of pieces of register data on the Y color and the M color for the page n+1. Only one serial communication line is provided, and hence in actuality, the pieces of register data on the respective colors are transmitted in succession as illustrated in FIG. 11D. Even when the CPU 1601 requests the transmission of the pieces of register data in synchronization with the reference timing signal while the transfer speed is set so that the transfer is finished within the time period shorter than the inter-drum movement time period Td, the transmission is started with a delay corresponding to each of segments indicated by the hatched portions in FIG. 11D in actuality. Therefore, as indicated by each of segments D, E, and F in FIG. 11C and FIG. 11D, a transmission completion timing of the register data for the page n+1 and a latent image formation start timing for the page n+1 are reversed. When the latent image formation is started before the register setting for the page "n" is completed, the register whose setting is yet to be completed still holds the register data for the previous page, to thereby fail to obtain a desired image and form an unsatisfactory image. Detailed descriptions relating to FIG. 10A to FIG. 10D and FIG. 11A to FIG. 11D are given later.

SUMMARY OF THE INVENTION

The present invention has been made under such circumstances, and therefore has an object to prevent an image failure ascribable to a data transfer timing.

In order to achieve the above-mentioned object, at least one embodiment of the present invention provides the following configurations.

According to at least one embodiment of the present invention, there is provided an image forming apparatus of a tandem type, the image forming apparatus including: a plurality of photoconductors arranged with a predetermined interval; an exposure unit, which includes a plurality of light sources corresponding to the plurality of photoconductors on a one-to-one basis, and is configured to form a latent image on each of the plurality of photoconductors; a generating unit configured to generate a drive signal for causing each of the plurality of light sources to perform one of turning on of light and turning off of light based on image data; and an output unit configured to output a parameter for generating the drive signal to the generating unit, wherein the output unit is configured to output the parameter to the generating unit at a transfer speed that is set so that the outputting of the parameters corresponding to the plurality of light sources is completed within a time period calculated from the predetermined interval and rotation speeds of the plurality of photoconductors.

According to at least one embodiment of the present invention, an image failure ascribable to a data transfer timing can be prevented.

Further features of the present invention will become apparent from the following description of exemplary embodiments with reference to the attached drawings.

DESCRIPTION OF THE EMBODIMENTS

[Overall Control Unit and Exposure Control Unit]

Figure 8:
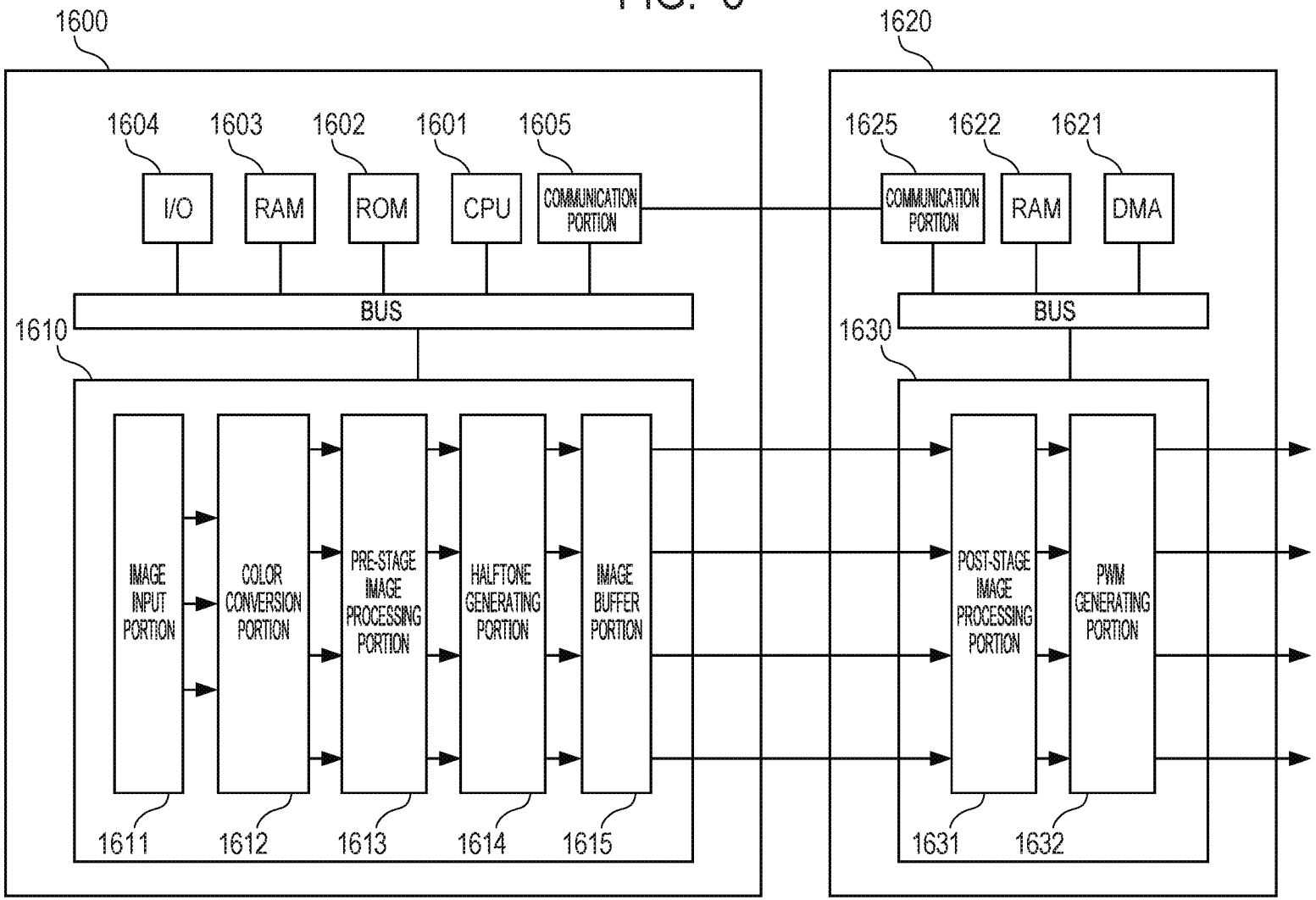
FIG. 8 is a block diagram of a related-art image forming apparatus.

FIG. 8 is an example of general control blocks of an image forming apparatus that employs an electrophotographic developing, which are configured to convert image data input to the image forming apparatus into a PWM signal for blinking light from an exposure device, and the image forming apparatus includes an overall control portion 1600 configured to control an overall operation of the image forming apparatus and an exposure control portion 1620 configured to control the exposure device. The overall control portion 1600 includes a CPU 1601, a ROM 1602, a RAM 1603, an I/O 1604, a communication portion 1605, a bus, and an image editing portion 1610. The image editing portion 1610 performs enlargement or reduction processing for printing image data of the A4 size on a printing sheet of the A3 size or printing image data of the A3 size on a printing sheet of the A4 size. The image editing portion 1610 also subjects the input image data to density adjustment and other such image processing designated by a user. The image editing portion 1610 includes, in its final stage, an image buffer portion 1615 configured to buffer the image data. Specifically, the image editing portion 1610 includes an image input portion 1611, a color conversion portion 1612, a pre-stage image processing portion 1613, a halftone generating portion 1614, and the image buffer portion 1615.

The exposure control portion 1620 includes direct memory access (DMA) 1621, a RAM 1622, a communication portion 1625, a bus, and an image correction portion 1630. The image correction portion 1630 performs correction corresponding to a position and a magnification of a latent image to be formed on a photoconductor and other such characteristics of the exposure device. The image correction portion 1630 includes a post-stage image processing portion 1631 and a PWM generating portion 1632. The image correction portion 1630 is mainly configured for a correction function corresponding to the kind (for example, laser or LED) of the exposure device. The image editing portion 1610 is configured mainly for functions to be used for products in common, and is used by a plurality of products in common, to thereby be able to reduce the manufacturing cost of the image forming apparatus.

The image editing portion 1610 is formed of a microcomputer or an ASIC, and includes a register configured to store a parameter for performing image processing. The CPU 1601 calculates the parameter based on the image processing designated by the user, and stores the parameter in the register included in the image editing portion 1610. In the same manner, the image correction portion 1630 is also formed of a microcomputer or an ASIC, and includes a register configured to store a parameter for performing image correction. The CPU 1601 calculates the parameter for performing the correction in accordance with the characteristics of the exposure device, and stores the parameter in the register included in the image correction portion 1630. The CPU 1601 stores the parameter in the register included in the image correction portion 1630 not through the bus but through serial communication, to thereby be able to reduce the number of wires connecting the CPU 1601 and the register, which allows further reduction in manufacturing cost.

Figure 9A:
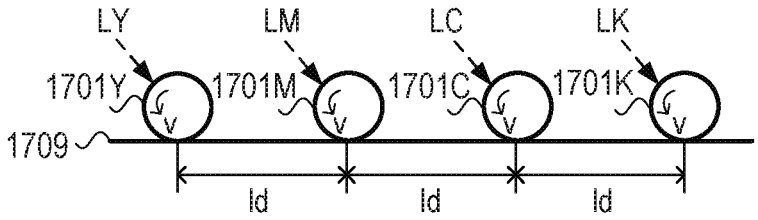
FIG. 9A is a view for illustrating how photoconductors are arranged in a related art.
Figure 9B:
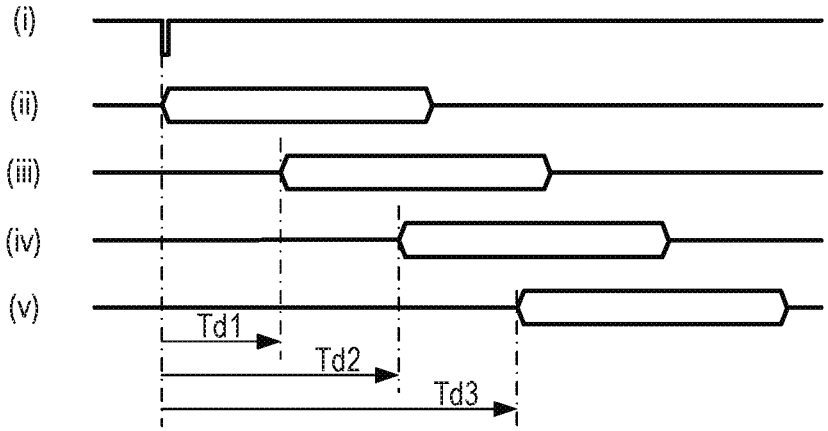
FIG. 9B, FIG. 9C, and FIG. 9D are diagrams for illustrating timings to form the latent images.

Next, a configuration of a main portion of an image forming apparatus of a tandem type and transmission of image data are described. FIG. 9A is a sectional view for illustrating a main portion of image forming portions of the image forming apparatus of the tandem type. When the image forming apparatus of the tandem type forms a color image, toner images of respective colors formed on photosensitive drums 1701Y, 1701M, 1701C, and 1701K, which are arranged at different positions, are required to be exactly superimposed on each other on a transfer belt 1709. Suffixes Y, M, C, and K to reference symbols indicate the colors of yellow, magenta, cyan, and black, respectively, and are omitted except for a case of specifically describing those colors. In a color image forming apparatus of the tandem type, a segment (hereinafter referred to as "latent image formation segment") in which a latent image is formed by a laser light L applied from an exposure device (not shown) is defined for each color in the following manner. FIG. 9B is a diagram for illustrating how the latent image formation segment is shifted depending on the color. In FIG. 9B, part (i) is a diagram for illustrating a waveform of a reference timing signal to be used as a reference when the latent image formation segment for each color is started. Part (ii) is a diagram for illustrating the latent image formation segment for yellow, part (iii) is a diagram for illustrating the latent image formation segment for magenta, part (iv) is a diagram for illustrating the latent image formation segment for cyan, and part (v) is a diagram for illustrating the latent image formation segment for black. Every horizontal axis represents time. The latent images are formed by applying the laser light L onto the photosensitive drum 1701 while timings are shifted by times Td1, Td2, and Td3 for magenta, cyan, and black, respectively, based on (in synchronization with) the reference timing signal in part (i) of FIG. 9B. The formation of a latent image corresponds to the hexagonal area in FIG. 9B. The latent image for yellow is formed when the reference timing signal is output.

Those times are expressed by Expressions (1-1) to (1-4) assuming that an inter-drum movement time period Td is calculated when a predetermined interval between the respective photosensitive drums 1701 is represented by 1*d* and a rotation speed (process speed) of a surface of each photosensitive drum 1701 is represented by "v". The inter-drum movement time period Td represents a time period required for the photosensitive drum 1701 rotating at the rotation speed "v" to rotate by a distance corresponding to the interval 1*d* between the photosensitive drums 1701.

$$Td=1d/v \tag{1-1}$$

$$Td1=Td\times 1 \tag{1-2}$$

$$Td2=Td\times 2 \tag{1-3}$$

$$Td3=Td\times 3 \tag{1-4}$$

Figure 9C:
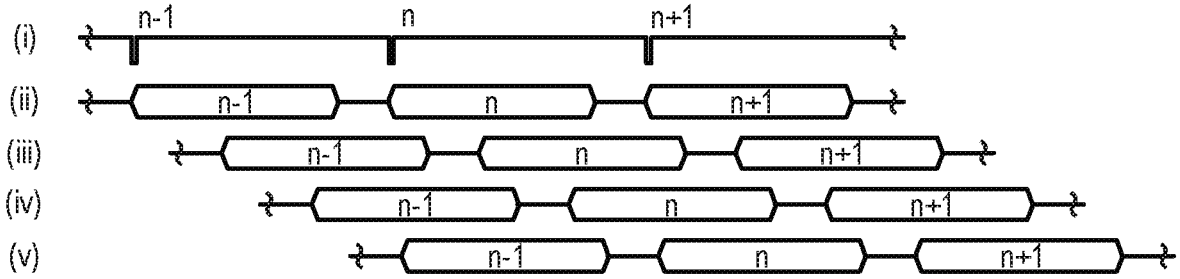

In a case of continuous printing in which printing is continuously performed on a plurality of sheets, the timings are as illustrated in FIG. 9C. In parts (i) to (v) of FIG. 9C, the same waveforms as those in parts (i) to (v) of FIG. 9B are illustrated. In addition, "n" indicates a page corresponding to the printing on the n-th sheet, n−1 indicates a page corresponding to the printing on the (n−1)th sheet, and n+1 indicates a page corresponding to the printing on the (n+1)th sheet, where "n" represents an integer equal to or larger than 2. As illustrated in FIG. 9C, the latent image formation segments for the page n−1, the page "n", and the page n+1 are shifted by a predetermined timing for each color to keep forming the latent images.

In this case, in the system illustrated in the block diagram of FIG. 8, the image buffer portion 1615 configured to accumulate the image data is arranged on the most downstream side in the image editing portion 1610, and it is possible to temporarily accumulate the image data subjected to different kinds of image processing in the image buffer portion 1615. Therefore, processing performed on upstream of the image buffer portion 1615 are performed prior to the timing to start the latent image formation, to thereby be able to perform the processing (asynchronously) without being synchronized with such timings of the latent image formation segments as illustrated in FIG. 9C. In the following description, the timing to start the latent image formation is referred to as "latent image formation start timing". In contrast, processing performed on downstream of the buffer configured to accumulate the image data, namely, the processing of the image correction portion 1630, is performed in synchronization with such timings of the latent image formation segments as illustrated in FIG. 9C.

In recent years, it has also become possible to insert a sheet different from a sheet used for main text into the image forming apparatus as a partition sheet during the continuous printing. When the partition sheet differs from the sheet used for main text in size, the CPU 1601 is required to change a parameter of each register. In recent years, it has also been general for the image forming apparatus to form a patch image for calculating a density change amount and a toner consumption amount on, for example, the transfer belt 1709 during the continuous printing. Even in such a case, the CPU 1601 is required to change the parameter of each register. In this manner, the parameter of the register is required to be changed during the continuous printing in a segment in which processing is not performed on any one of the pages, that is, a segment (hereinafter referred to as "sheet gap segment") between a trailing edge of a given page and a leading edge of the subsequent page (hereinafter referred to as "sheet gap"). This is because a switch is made to an operation corresponding to a parameter for another page when the parameter of the register is changed during the processing for the page, to thereby fail to obtain a desired result regarding the currently processed page.

Figure 9D:
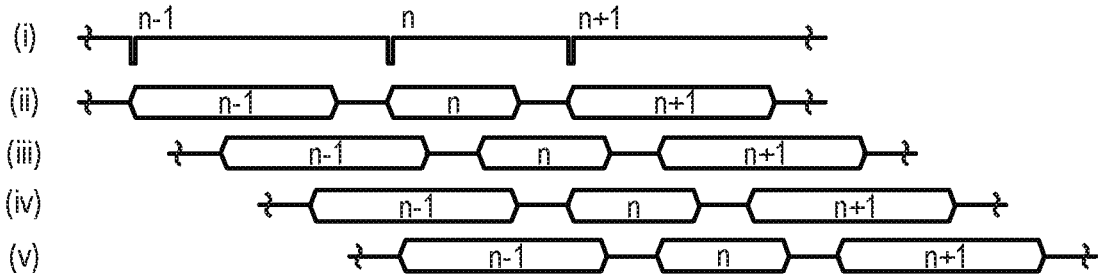

This means that the parameter of the register of the image correction portion 1630 to be used for the processing performed on downstream of the buffer configured to accumulate the image data is required to be changed in synchronization with the latent image formation segments illustrated in FIG. 9D. In parts (i) to (v) of FIG. 9D, the same waveforms as the waveforms in parts (i) to (v) of FIG. 9C are illustrated. In FIG. 9D, it is illustrated how the page "n" during the continuous printing differs in size from (for example, smaller in size than) the preceding page n−1 and the succeeding page n+1 by setting the lengths of hexagons in the horizontal axis direction different from each other. In such a case, the parameter of the register of the image correction portion 1630 is changed in the sheet gap segments before and after the page "n" (segments indicated by the straight line before and after the hexagonal area representing the latent image formation segment for the page "n").

The parameter of the register of the image correction portion 1630 is changed by the CPU 1601 through the communication portion 1605 and the communication portion 1625, which are configured to perform serial communication. When the sheet gap segment is sufficiently long for the number of registers whose parameters are to be changed, that is, when all pieces of data of the registers whose parameters are required to be changed within the sheet gap segment can be transmitted through serial communication, the parameters may be changed in the sheet gap segment as they are. However, in recent years, the number of registers tends to further increase due to an increase in demand for higher image quality, and at the same time, the sheet gap segment tends to become shorter for improvement in productivity of the image forming apparatus. Under such circumstances, it is sometimes impossible to complete the transmission of all the pieces of data of the registers that are required to be changed within the sheet gap segment. In such a case, it is possible to transfer the data by the following scheme. For example, the CPU 1601 stores register data in the RAM 1622 of the image correction portion 1630 before the sheet gap segment in advance. Then, when the sheet gap segment is reached, the DMA 1621 transfers the register data stored in the RAM 1622 to the register. In the following description, the timing at which the transmission of the register data is completed is referred to as "transmission completion timing". In general, the latent image formation segment is sufficiently longer than the sheet gap segment, and data transfer from a RAM to the register by DMA is also faster than a transfer speed of serial communication. Therefore, by employing the above-mentioned scheme, it is possible to reflect more pieces of register data in the registers even in a short sheet gap segment.

Figure 10A:
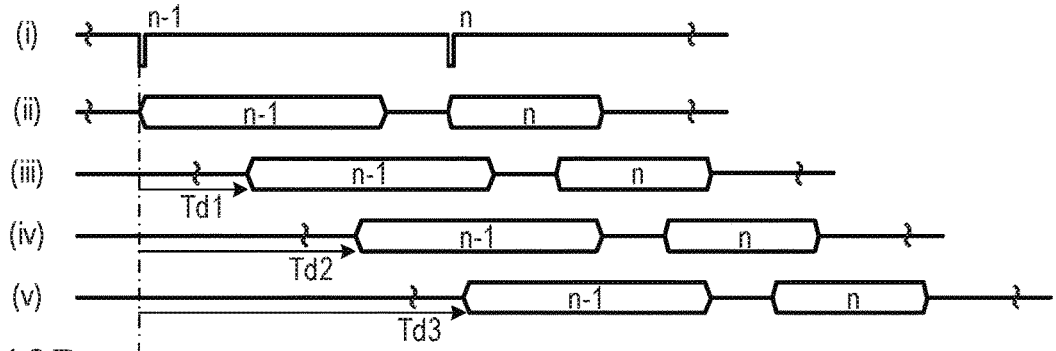
FIG. 10A, FIG. 10B, FIG. 10C, and FIG. 10D are diagrams for illustrating how parameters are transmitted in the related art.
Figure 10B:
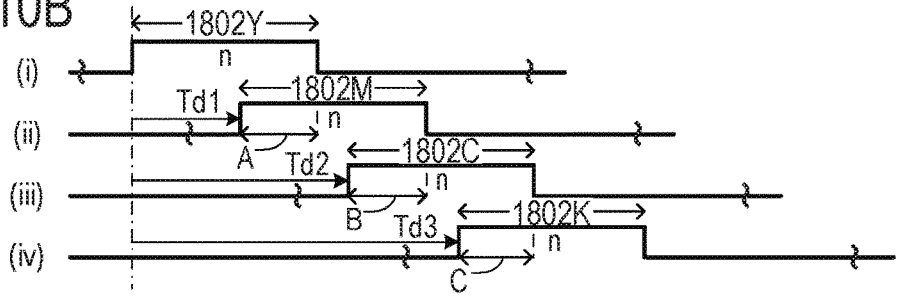
Figure 10C:
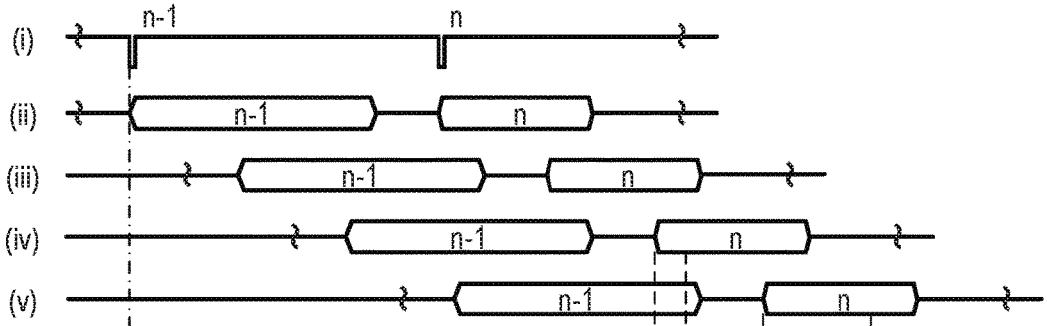

In FIG. 10A, it is illustrated how the latent images of the page n−1 and the page "n" that is different in size from (smaller in size than) that of the page n−1 are formed, and waveforms similar to those in, for example, FIG. 9B are illustrated in parts (i) to (v). In FIG. 10A, it is illustrated how the latent image formation segments for the respective colors indicated in parts (ii) to (v) are determined based on the reference timing signal in part (i). In parts (i) to (iv) of FIG. 10B, "ideal" segments for the respective colors in which the CPU 1601 transmits the pieces of register data on the respective colors to the RAM 1622 of the image correction portion 1630 through serial communication are illustrated. In this case, it is illustrated how the register data for the page "n" is transmitted in advance in synchronization with a reference timing signal for the page n−1. In FIG. 10B, a segment having a high level waveform indicates a transmission segment 1802 of all pieces of register data whose parameters are required to be changed. In this case, such a transfer speed that a transmission time period of all pieces of register data required for forming a latent image of one color is required to be longer than the inter-drum movement time period Td is defined. For example, the transmission segment 1802Y of the register data on the Y color in part (i) requires a segment longer than Td1 (1802Y>Td). However, when a close look is taken at FIG. 10B, there are overlapping segments A, B, and C between respective transmission segments in parts (i) to (iv). That is, the transmission segments of pieces of register data overlap with each other between different colors for the same page. As illustrated in FIG. 8, only one serial communication line is provided, and hence the pieces of register data cannot be transmitted in such "ideal" segments. In an actual case, as illustrated in parts (i) to (iv) of FIG. 10D, the pieces of register data on the respective colors are transmitted in succession. In synchronization with the reference timing signal for the page n−1, the CPU 1601 requests the transmission of the register data on the Y color for the subsequent page "n". Even when the CPU 1601 requests the transmission of the pieces of register data on the M, C, and K colors with the intervals of Td1, Td2, and Td3, respectively, from the reference timing signal for the page n−1, the transmission is started with a delay corresponding to each of segments indicated by the hatched portions in FIG. 10D in actuality. FIG. 10C is a diagram for illustrating the same waveforms as those in FIG. 10A.

Figure 10D:
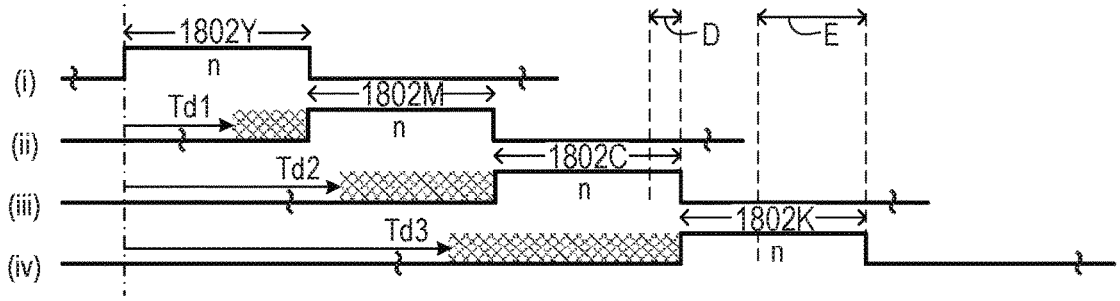

Then, as indicated by, for example, a segment D in FIG. 10C and FIG. 10D, the transmission completion timing of the register data on the C color for the page "n" follows (becomes later than) the latent image formation start timing of the C color for the page "n". That is, there occurs a situation in which the transmission of the register data is yet to be completed. The same phenomenon occurs with the K color as indicated by a segment E in FIG. 10D. In this manner, when the latent image formation is started before register setting for the page "n" is completed, the register whose setting is yet to be completed still holds the register data for the previous page, to thereby fail to obtain a desired image and form an unsatisfactory image.

In order to avoid the above-mentioned situation, it is desired to set the transfer speed so as to finish the transmission of all pieces of register data required for forming latent images of the respective colors at least within a time period shorter than the inter-drum movement time period Td. However, even when the transfer speed is set so that the transmission of all the pieces of register data required for forming the latent images of the respective colors is finished within the time period shorter than the inter-drum movement time period Td, the following problem may further occur.

Figure 11A:
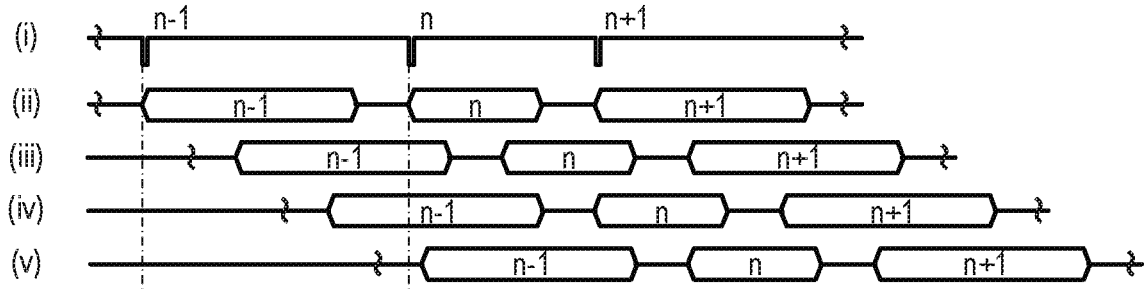
FIG. 11A, FIG. 11B, FIG. 11C, and FIG. 11D are diagrams for illustrating how the parameters are transmitted during continuous printing in the related art.

In FIG. 11A, it is illustrated how the page "n" during the continuous printing is different in size from (smaller in size than) those of the preceding page n−1 and the succeeding page n+1. FIG. 11A is also an illustration of a case in which the transfer speed is set so that the transmission of all the pieces of register data is completed within the time period shorter than the inter-drum movement time period Td. FIG. 11A and FIG. 11C are diagrams for illustrating the same waveforms as those in FIG. 10A and FIG. 10C, respectively. In such a case, the following control is performed. That is, the CPU 1601 is required to transmit the register data for the page "n" to the RAM 1622 of the image correction portion 1630 before the latent image formation start timing for the page "n". In addition, the CPU 1601 is required to transmit the register data for the page n+1 to the RAM 1622 of the image correction portion 1630 before the latent image formation start timing for the page n+1. Therefore, as illustrated in parts (i) to (iv) of FIG. 11B, in synchronization with the reference timing signal for the page n−1, the pieces of register data on the respective colors of Y, M, C, and K for the subsequent page "n" are transmitted. Transmission segments 1902Y[n], 1902M[n], 1902C[n], and 1902K[n] are transmission segments of the pieces of register data on the respective colors for the page "n". In the same manner, in synchronization with a reference timing signal for the page "n", the pieces of register data on the respective colors of Y, M, C, and K for the subsequent page n+1 are transmitted. Transmission segments 1902Y[n+1], 1902M[n+1], 1902C[n+1], and 1902K[n+1] are transmission segments of the pieces of register data on the respective colors for the page n+1. In this case, the transfer speed is defined so that the transmission segments 1902 of all the pieces of register data required for forming the latent image of one color fall below the inter-drum movement time period Td. For example, as illustrated in part (i) of FIG. 11B, the transmission segment 1902Y[n] of the register data on the Y color for the page "n" is slightly shorter than the inter-drum movement time period Td (Td>1902Y).

Figure 11B:
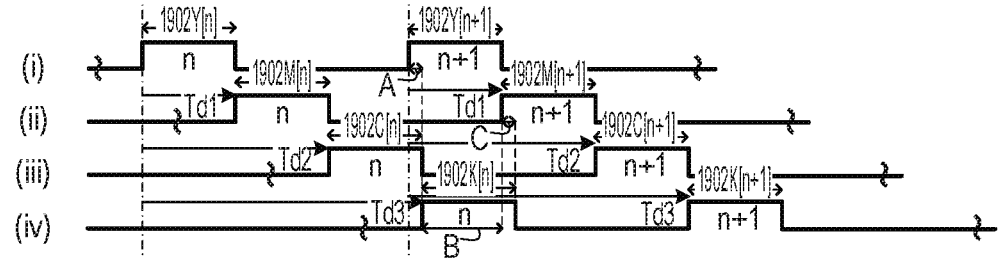
Figure 11C:
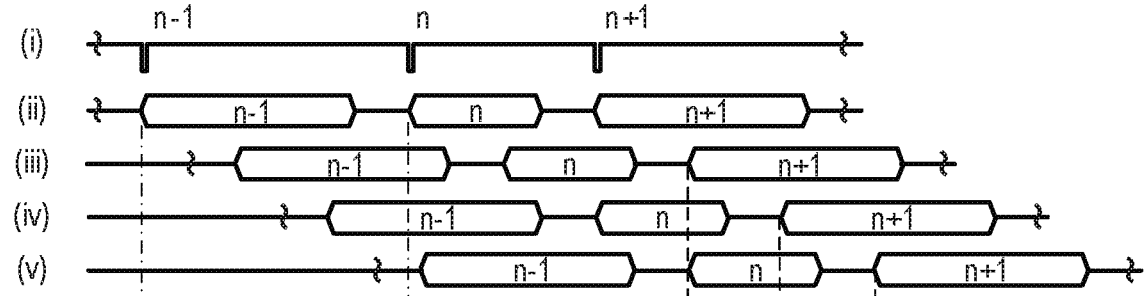

However, when a close look is taken at FIG. 11B, it is found that the overlapping segment A is present between the transmission segment 1902C[n] of the register data on the C color for the page "n" and the transmission segment 1902Y [n+1] of the register data on the Y color for the page n+1. In addition, the overlapping segments B and C are present between the transmission segment 1902K[n] of the register data on the K color for the page "n" and the transmission segments 1902Y[n+1] and 1902M[n+1] of the pieces of register data on the Y color and the M color for the page n+1. In this case, the overlapping segment A refers to a segment in which the transmission segment of the register data on the C color for the page "n", which is illustrated in part (iii) of FIG. 11B, and the transmission segment of the register data on the Y color for the page n+1, which is illustrated in part (i), overlap with each other. The overlapping segment B refers to a segment in which the transmission segment of the register data on the K color for the page "n", which is illustrated in part (iv), and the transmission segment of the register data on the Y color for the page n+1, which is illustrated in part (i), overlap with each other. The overlapping segment C refers to a segment in which the transmission segment of the register data on the K color for the page "n", which is illustrated in part (iv), and the transmission segment of the register data on the M color for the page n+1, which is illustrated in part (ii), overlap with each other. That is, the transmission segments of the pieces of register data do not overlap with each other between different colors for the same page, but the transmission segments of the pieces of register data overlap with each other between different colors for different pages. Only one serial communication line is provided, and hence in actuality, the pieces of register data cannot be transmitted in the illustrated manner. In this case, as illustrated in parts (i) to (iv) of FIG. 11D, the pieces of register data on the respective colors are transmitted in succession.

From the above, the CPU 1601 requests the transmission of the register data on the Y color for the subsequent page "n" in synchronization with the reference timing signal for the page n−1. The CPU 1601 further requests the transmission of the pieces of register data on the M, C, and K colors with the intervals of Td1, Td2, and Td3, respectively, from the reference timing signal for the page n−1. In the same manner, in synchronization with the reference timing signal for the page "n", the CPU 1601 requests the transmission of the register data on the Y color for the subsequent page n+1. The CPU 1601 further requests the transmission of the register data on the M, C, and K colors with the intervals of Td1, Td2, and Td3, respectively, from the reference timing signal for the page "n". However, even when the CPU 1601 makes those requests, the transmission of the register data on each color for each page is started with a delay corresponding to each of segments indicated by the hatched portions in FIG. 11D in actuality.

Figure 11D:
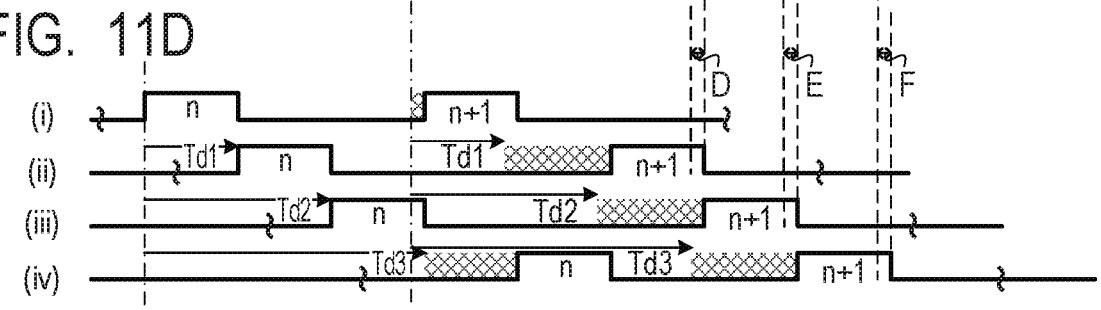

Then, as indicated by each of segments D, E, and F in FIG. 11C and FIG. 11D, the transmission completion timing of the register data for the page n+1 and the latent image formation start timing for the page n+1 are reversed. That is, there occurs a situation in which the transmission of the register data is yet to be completed (with the M color, the C color, and the K color for the page n+1 in FIG. 11B and FIG. 11C). Specifically, as indicated by the segment D, the latent image formation start timing of the M color is reached before the transmission completion timing of the register data on the M color. As indicated by the segment E, the latent image formation start timing of the C color is reached before the transmission completion timing of the register data on the C color. As indicated by a segment F, the latent image formation start timing of the K color is reached before the transmission completion timing of the register data on the K color. In this manner, when the latent image formation is started before the register setting for the page n+1 is completed, the register whose setting is yet to be completed still holds the register data for the previous page, to thereby fail to obtain a desired image and form an unsatisfactory image.

EMBODIMENTS

Exemplary embodiments of the present invention are illustratively described in detail below with reference to the drawings. A direction of an axis of rotation of a photosensitive drum, which is a direction in which scanning is performed with a laser beam, is defined as a main scanning direction, which is a second direction, and a rotational direction of the photosensitive drum, which is a direction substantially orthogonal to the main scanning direction, is defined as a sub-scanning direction, which is a first direction.

[Image Forming Apparatus]

Figure 1A:
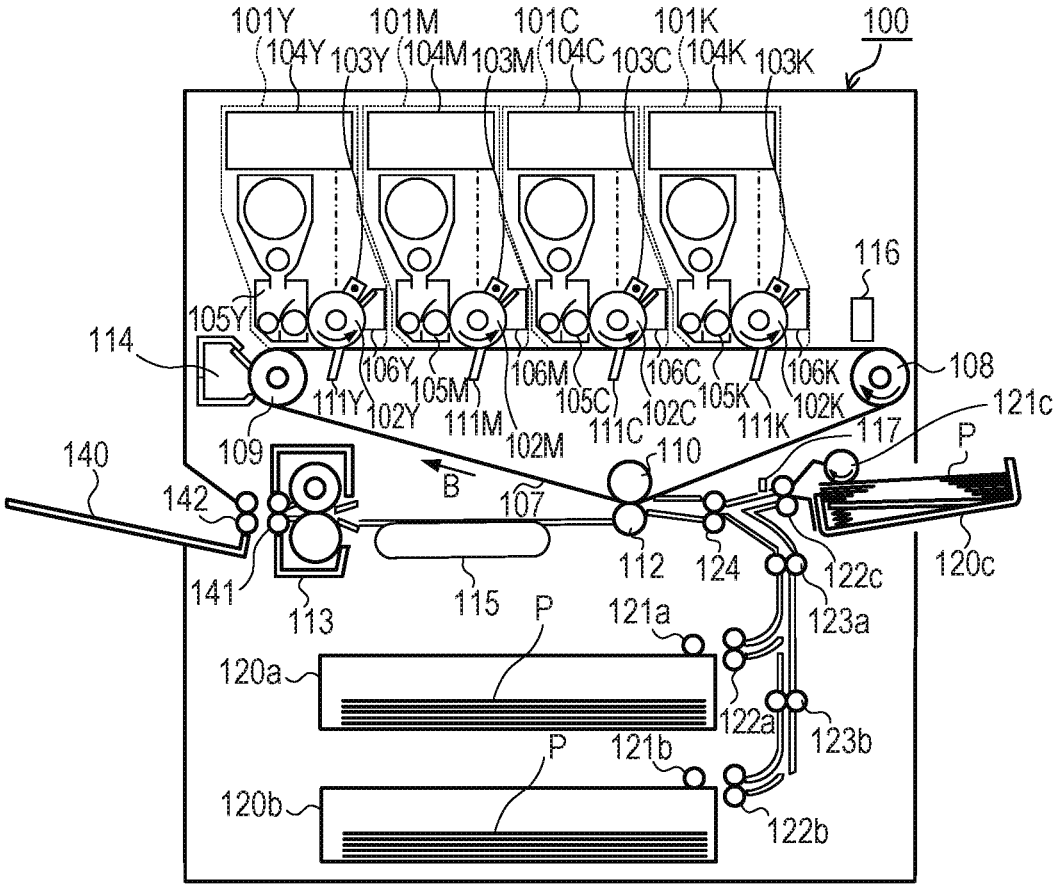
FIG. 1A is a view for illustrating an overall configuration of an image forming apparatus according to an embodiment of the present invention.

FIG. 1A is a schematic sectional view of a color image forming apparatus having toners of a plurality of colors. An image forming apparatus 100 includes four image forming portions 101Y, 101M, 101C, and 101K configured to form images of respective colors. In this case, Y, M, C, and K indicate yellow, magenta, cyan, and black, respectively. The image forming portions 101Y, 101M, 101C, and 101K form images through use of the toners of yellow, magenta, cyan, and black, respectively. In the following description, the suffixes Y, M, C, and K to reference symbols are omitted except for a case of being required. The image forming portion 101 includes a photosensitive drum 102 being a photoconductor. A charging device 103, a light scanning device 104, and a developing device 105 are provided around the photosensitive drum 102. The developing device 105 develops an electrostatic latent image, which has been formed on the photosensitive drum 102 by being exposed to light by the light scanning device 104, through use of the toner of a predetermined color. A cleaning device 106 is also arranged around the photosensitive drum 102.

An intermediate transfer belt 107 being a transferring member having an endless belt shape is arranged below the photosensitive drum 102. The intermediate transfer belt 107 is looped around a driving roller 108 and driven rollers 109 and 110, and is rotated in a direction indicated by the arrow B in FIG. 1A (clockwise) during image formation. A primary transfer device 111 is provided at each position opposed to the photosensitive drum 102 across the intermediate transfer belt 107. In a rotation direction of the intermediate transfer belt 107, a position at which a toner image is to be transferred from the photosensitive drum 102Y onto the intermediate transfer belt 107 is located on upstream of a position at which a toner image is to be transferred from the photosensitive drum 102M onto the intermediate transfer belt 107. The image forming apparatus 100 also includes a secondary transfer roller 112 configured to transfer the toner image on the intermediate transfer belt 107 (on the belt) onto a sheet P being a recording material and a fixing device 113 configured to fix the unfixed toner image onto the sheet P. The primary transfer device 111, the intermediate transfer belt 107, the driving roller 108, the driven rollers 109 and 110, and the secondary transfer roller 112 function as a transfer unit.

During a printing operation, the photosensitive drum 102 and the intermediate transfer belt 107 are rotationally driven by a driving mechanism (not shown) in the direction indicated by the arrow in FIG. 1A, and are subjected to a series of steps for image formation described below, to thereby form a print image. In a charging step, the surface of the photosensitive drum 102Y is first uniformly charged to a predetermined potential by a voltage applied from the charging device 103Y. Then, in an exposure step, the surface of the photosensitive drum 102Y is exposed to a laser beam emitted from the light scanning device 104Y. The laser beam is normally blinked in accordance with data on an original image, which causes a potential difference corresponding to the data on the original image on the surface of the photosensitive drum 102Y, to thereby form an electrostatic latent image. Then, in the subsequent developing step, a voltage is applied to the developing device 105Y to maintain the toner in the developing device 105Y at a predetermined potential, to thereby develop the electrostatic latent image on the surface of the photosensitive drum 102Y to form a yellow toner image. In regard to the colors of magenta, cyan, and black, the surfaces of the photosensitive drums 102M, 102C, and 102K, respectively, are also subjected to the same steps as those described above to form toner images. In the subsequent primary transfer step, a primary transfer voltage is applied to the primary transfer device 111, to thereby transfer the toner images of the respective colors formed on the photosensitive drum 102 from the surface of each photosensitive drum 102 onto the surface of the intermediate transfer belt 107. In this case, the toner images of the respective colors are superimposed on each other.

In the subsequent secondary transfer step, a secondary transfer voltage is applied to the secondary transfer roller 112, to thereby transfer the toner images superimposed on each other on the surface of the intermediate transfer belt 107 from a first sheet feeding cassette 120*a* onto the surface of the sheet P that has been conveyed to a secondary transfer portion. The sheet P is conveyed from the first sheet feeding cassette 120*a* to the secondary transfer portion by a conveyance roller 121*a*, conveyance rollers 122*a*, conveyance rollers 123*a*, and conveyance rollers 124, which are rotationally driven by a driving mechanism (not shown). The image forming apparatus 100 also includes a second sheet feeding cassette 120*b* and a manual feed tray 120*c*. The sheet P fed from the second sheet feeding cassette 120*b* is conveyed to the secondary transfer portion by a conveyance roller 121*b*, conveyance rollers 122*b*, conveyance rollers 123*b*, conveyance rollers 123*a*, and the conveyance rollers 124, which are rotationally driven by a driving mechanism (not shown). The sheet P fed from the manual feed tray 120*c* is conveyed to the secondary transfer portion by a conveyance roller 121*c*, conveyance rollers 122*c*, and the conveyance rollers 124, which are rotationally driven by a driving mechanism (not shown). The sheets P of a plurality of sizes can be placed in each of the first sheet feeding cassette 120*a* and the second sheet feeding cassette 120*b*. In regard to the size of the sheet P placed in each of the first sheet feeding cassette 120*a* and the second sheet feeding cassette 120*b*, a detection result obtained by a size detecting device (not shown) is output to a CPU 301 described later, to thereby allow the CPU 301 to detect the size of the sheet P placed in each of the above-mentioned cassettes. The sheets P of a plurality of sizes can be placed on the manual feed tray 120*c* as well. A size sensor 117 configured to detect the size of a sheet placed on the manual feed tray 120*c* is arranged on the manual feed tray 120*c*. The CPU 301 can identify the size of the sheet P conveyed from the manual feed tray 120*c* to the secondary transfer portion based on a detection result obtained by the size sensor 117. The CPU 301 can also identify the size of the sheet P on the manual feed tray 120*c* based on information input by the user through an operation panel (not shown). The above-mentioned partition sheet (recording medium inserted between pieces of printed matters) is fed from the second sheet feeding cassette 120*b* or the manual feed tray 120*c*.

The toner remaining on the intermediate transfer belt 107 without being transferred onto the sheet P is collected by a cleaner 114 arranged on downstream of the secondary transfer portion in a conveyance direction so as to be opposed to the intermediate transfer belt 107. The secondary transfer roller 112 can also apply a voltage having a polarity reverse to the secondary transfer voltage for transferring the toner on the surface of the intermediate transfer belt 107 onto the sheet P. With this configuration, it is possible to move the toner adhering to the secondary transfer roller 112 toward the surface of the intermediate transfer belt 107 to collect the toner by the cleaner 114. Meanwhile, the cleaning device 106 removes the toner from the surface of each photosensitive drum 102 onto which the transferring has been finished. The photosensitive drum 102 from which the toner remaining on the surface has been removed keeps being rotated to return to a position for the charging step. The sheet P onto which the toner image has been transferred in the secondary transfer portion is conveyed to the fixing device 113 by a conveyor belt 115, and the toner image transferred onto the sheet P is heated and fixed to the sheet P by the fixing device 113. The sheet P on which the full-color image has been formed in this manner passes through conveyance rollers 141 and conveyance rollers 142, which are rotationally driven in the final stage, to be delivered to a delivery portion 140.

In addition, a sensor 116 serving as a detection unit is a sensor configured to detect an image formed on the intermediate transfer belt 107. In the image forming apparatus 100, in order to adjust image quality, toner images for detection called "patches" having various sizes and various patterns are sometimes formed between a toner image to be transferred onto the sheet P and a toner image to be transferred onto the subsequent sheet P during the continuous printing. In the following description, the toner images for detection called "patches" having various sizes and various patterns are referred to as "patch images". The sensor 116 detects the patch image formed on the intermediate transfer belt 107, and outputs a result of the detection to the CPU 301. The CPU 301 executes the correction of the image data based on the detection result obtained by the sensor 116. When the patch image being a predetermined toner image is formed during the continuous printing, the patch image differs from the sheet P in size, and hence the same problem as in the above-mentioned case of inserting the partition sheet occurs.

[Light Scanning Device]

Figure 1B:
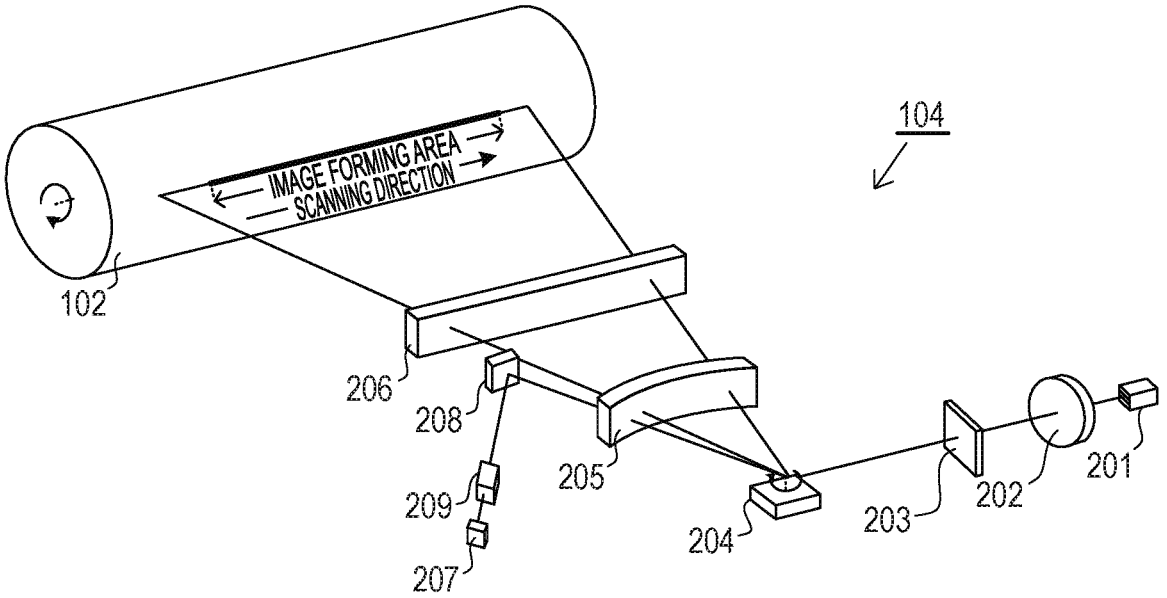
FIG. 1B is a view for illustrating a main part of a light scanning device.

FIG. 1B is a view for illustrating an internal configuration of the light scanning device 104 configured to emit a light beam, which serves as an exposure unit. The light scanning device 104 includes a semiconductor laser 201 serving as a light source, a collimator lens 202, a cylindrical lens 203, and a rotary polygon mirror 204. The semiconductor laser 201 generates, for example, four laser beams as a light beam. The collimator lens 202 shapes the laser beam emitted from the semiconductor laser 201 into a collimated beam. The cylindrical lens 203 condenses the laser beam that has passed through the collimator lens 202 in a sub-scanning direction. The light scanning device 104 further includes a first scanning lens 205, onto which the laser beam (scanning light) deflected by the rotary polygon mirror 204 is to be emitted, and a second scanning lens 206. The rotary polygon mirror 204 is rotated by a drive motor (not shown) configured to drive the rotary polygon mirror 204 during the printing operation. In accordance with the rotation of the rotary polygon mirror 204, the laser beam emitted from the semiconductor laser 201 is deflected while continuously having the angle changed by its reflection surface. Then, the laser beam deflected by the rotary polygon mirror 204 passes through the first scanning lens 205 and the second scanning lens 206, and scans the photosensitive drum 102 in a main scanning direction being a scanning direction. With this scanning, the surface of the photosensitive drum 102 is exposed to light, and an electrostatic latent image is formed thereon. An area in which the electrostatic latent image is to be formed in the main scanning direction is set as an image forming area.

A mirror 208 is arranged in an edge part of a scanning range of the laser beam (outside the image forming area on the photosensitive drum 102) between the first scanning lens 205 and the second scanning lens 206. The mirror 208 reflects the laser beam that has entered through the first scanning lens 205, and folds back an optical path of the laser beam. In this case, the laser beam having the optical path folded back is detected by a beam detector 207 (hereinafter referred to as "BD 207") through a lens 209. When the laser beam emitted from the semiconductor laser 201 is detected by the BD 207, the BD 207 outputs a signal to the CPU 301 described later. The CPU 301 emits a laser beam corresponding to the image data from the semiconductor laser 201 to the image forming area by using a signal (hereinafter referred to as "synchronization signal") input from the BD 207 as a reference, to thereby align positions to start to form an electrostatic latent image (simply an image) in the main scanning direction for respective scans. In this manner, the synchronization signal is a signal to be used for obtaining a timing to start writing in the main scanning direction. The image forming portion 101 is not always required to employ such a scheme as described above in which a laser beam is scanned by deflecting the laser beam through use of the rotary polygon mirror 204 to expose the photosensitive drum 102 to light. The image forming portion 101 may employ another scheme, for example, such a scheme as to perform exposure by directly irradiating the photosensitive drum 102 with light from an LED array formed of LEDs arranged on a line head.

[Arithmetic Operation Unit and Exposure Control Unit]

Figure 2:
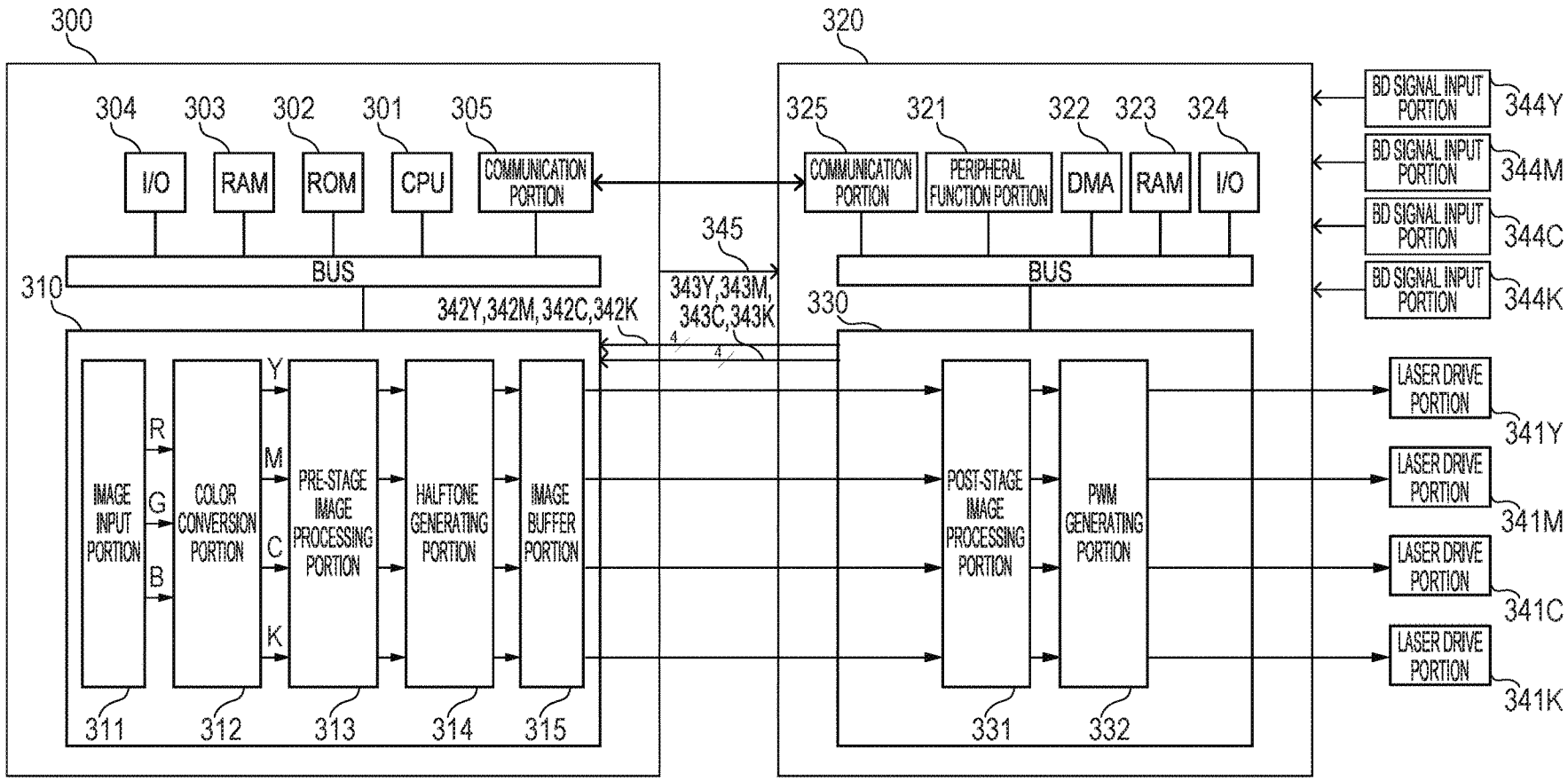
FIG. 2 is a block diagram of the image forming apparatus according to this embodiment.

FIG. 2 is a block diagram for illustrating a configuration of a control circuit configured to perform drive control of the light scanning device 104, and the control circuit includes an arithmetic operation portion 300 and an exposure control portion 320. The arithmetic operation portion 300 includes the CPU 301 and a ROM 302 configured to store a control program for the CPU 301. The arithmetic operation portion 300 includes a RAM 303, an I/O 304, a communication portion 305, and an image processing portion 310. The RAM 303 provides a working area. The I/O 304 inputs an input signal from a sensor included in the image forming apparatus 100, and outputs an output signal to a motor or other such actuator. The communication portion 305 is an interface for serial communication. Signals are transmitted and received between the respective portions through a bus.

The image processing portion 310 includes an image input portion 311, a color conversion portion 312, a pre-stage image processing portion 313, a halftone generating portion 314, and an image buffer portion 315. The arrows extending from left to right in the image processing portion 310 indicate flows of processing for image data input from an original reading apparatus, a computer, or other such external apparatus. The image data formed of color information on red (R), green (G), and blue (B) is input to the image input portion 311 from the original reading apparatus, the computer, or other such external apparatus. The image input portion 311 outputs the RGB image data to the color conversion portion 312. The color conversion portion 312 converts the input image data into image data on yellow (Y), magenta (M), cyan (C), and black (K) being the colors of toners for the image forming apparatus 100, and outputs the image data obtained by the conversion to the pre-stage image processing portion 313. The pre-stage image processing portion 313 executes different kinds of image processing, and outputs the image data subjected to the image processing to the halftone generating portion 314. The halftone generating portion 314 generates halftone data based on screen processing or error diffusion processing, and outputs the generated halftone data to the image buffer portion 315. The image buffer portion 315 stores the halftone data. For example, the pre-stage image processing portion 313 performs the enlargement or reduction processing for printing the image data on the A4 size on the printing sheet of the A3 size or printing the image data of the A3 size on the printing sheet of the A4 size. The pre-stage image processing portion 313 also performs the density adjustment for performing printing with a density in accordance with the user's preference and other such processing.

The exposure control portion 320 serving as a generating unit includes a peripheral function portion 321, DMA 322, a RAM 323, an I/O 324, a communication portion 325, and an image correction portion 330. Signals are transmitted and received between the respective portions through a bus. The I/O 324 inputs an input signal from, for example, the BD 207 included in the light scanning device 104, and outputs an output signal to a scanner motor or other such actuator. The image correction portion 330 includes a post-stage image processing portion 331 and a PWM generating portion 332. In order to correct color misregistration, the post-stage image processing portion 331 performs correction of an image position for each color, correction of an image magnification for each color, and other such processing. The image processing portion 310 and the image correction portion 330 are connected to each other through a hardware signal line 345 to be used by the CPU 301 to output a reference timing signal being a reference signal to the image correction portion 330. The image processing portion 310 and the image correction portion 330 are also connected to each other through hardware signal lines 342Y, 342M, 342C, and 342K for outputting vertical synchronization signals from the image correction portion 330 to the image buffer portion 315 of the image processing portion 310. The image processing portion 310 and the image correction portion 330 are further connected to each other through hardware signal lines 343Y, 343M, 343C, and 343K for outputting horizontal synchronization signals from the image correction portion 330 to the image buffer portion 315 of the image processing portion 310. Vertical synchronization signals 342 are transmitted and received through the hardware signal lines 342Y, 342M, 342C, and 342K, and horizontal synchronization signals 343 are transmitted and received through the hardware signal lines 343Y, 343M, 343C, and 343K. When a signal for a specific color is described, for example, "Y" is suffixed to the reference symbol of any one of the signals.

When the reference timing signal is input from the CPU 301, the image correction portion 330 outputs the vertical synchronization signal 342 to the image buffer portion 315 for each color. The image correction portion 330 also outputs the horizontal synchronization signal 343 to the image buffer portion 315 based on a signal from a BD signal input portion 344 being a portion configured to input a signal output from the BD 207. After a timing at which the vertical synchronization signal 342 is input from the image correction portion 330, the image buffer portion 315 outputs the image data stored therein to the post-stage image processing portion 331 of the image correction portion 330 in synchronization with the horizontal synchronization signal 343. The image data output from the image buffer portion 315 passes through the post-stage image processing portion 331, and is converted by the PWM generating portion 332 into a PWM signal being a drive signal to be used as a blinking pattern (pattern of turning on or off the light) of the semiconductor laser 201. The PWM signal is input to a laser drive portion 341 configured to drive the semiconductor laser 201 included in the light scanning device 104, and the semiconductor laser 201 irradiates the photosensitive drum 102 with the light beam corresponding to the image data. With the above-mentioned operation, the latent image is formed on the surface of the photosensitive drum 102.

Parameters required for operations of the post-stage image processing portion 331 and the PWM generating portion 332 of the image correction portion 330, generation of the vertical synchronization signal 342 and the horizontal synchronization signal 343, and other such operations are transmitted as the register data from the CPU 301 serving as an output unit through the communication portions 305 and 325. The CPU 301 calculates a parameter for performing the correction in accordance with the characteristics of the light scanning device 104. The communication is performed by a start-stop synchronization system based on standards of, for example, a universal asynchronous receiver transmitter (UART). The communication portions 305 and 325 apply parallel-serial conversion or serial-parallel conversion to data to be transmitted or received.

Figure 3B:
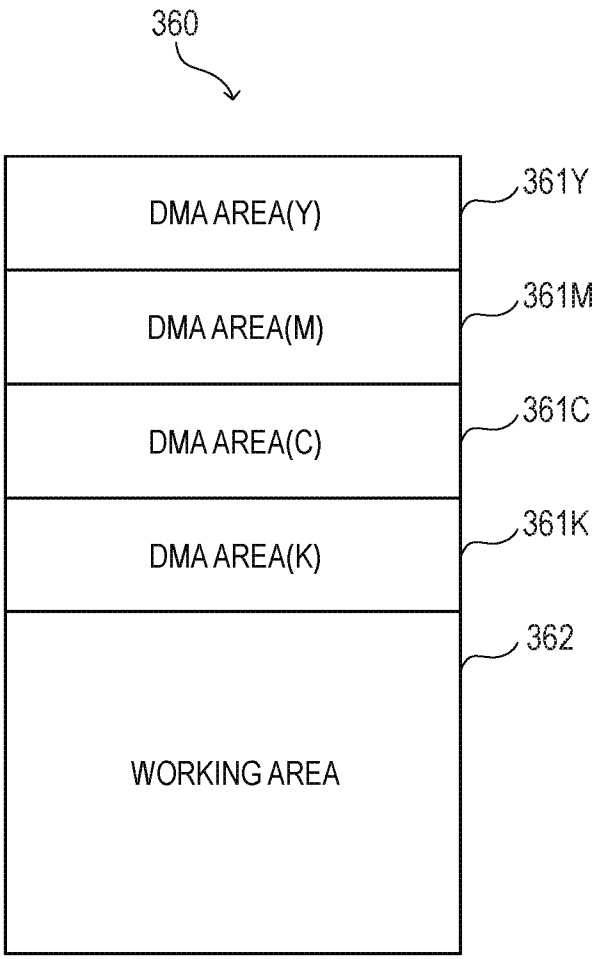
FIG. 3B is a diagram for illustrating an address space of a RAM.
Figure 3A:
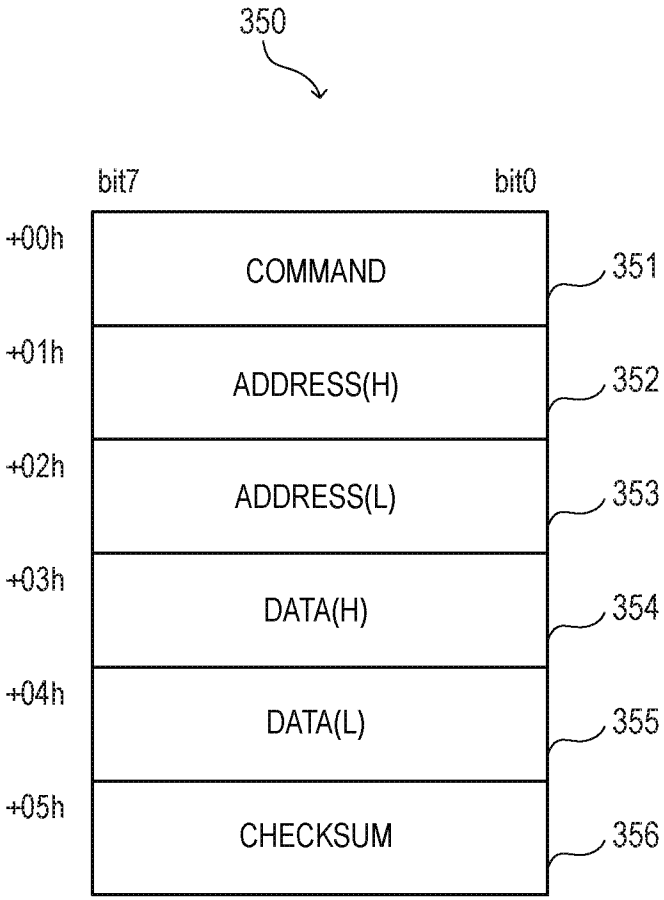
FIG. 3A is a diagram for illustrating register data in this embodiment.

In this embodiment, one piece of register data is formed as such packet data 350 as illustrated in FIG. 3A. FIG. 3A is a diagram for illustrating the packet data 350. The packet data 350 is formed of data having, for example, 6 bytes, which is formed of a command 351, an address (H) 352, an address (L) 353, data (H) 354, data (L) 355, and a checksum 356 in the stated order from its head. In regard to sizes of respective elements, a command has 1 byte, high-order and low-order addresses have 2 bytes in total, high-order and low-order pieces of data have 2 bytes in total, and a checksum has 1 byte.

The command 351 is used for instructing which one of writing (Write) of data and reading (Read) of data is to be performed to/from the address (H) 352 and the address (L) 353 that follow the command 351. In Table 1, a value of a command and instruction content are shown.

TABLE 1

| Command Type ID | Kind |
|---|---|
| 00 | Write |
| 01 | Read |

Table 1 is a table for showing an ID indicating a kind of a command in the first column and the kind of the command in the second column. The value of the command and the instruction content are associated with each other so that the writing (Write) is to be performed with the value of "00" and the reading (Read) is to be performed with the value of "01" as shown in, for example, Table 1. The data shown in Table 1 is stored in advance in, for example, the ROM 302. The address (H) 352 and the address (L) 353 are formed of data having 16 bits in total, and are used for designating access destinations in the RAM 323, the DMA 322, and the I/O 324 inside the exposure control portion 320 and the respective registers inside the image correction portion 330. The data (H) 354 and the data (L) 355 are used for designating the data to be written to the access destinations designated by the address (H) 352 and the address (L) 353, respectively, when the command 351 is Write. The checksum 356 is a checksum for determining whether or not the data has been normally transmitted. In this embodiment, when the data having 1 byte (8 bits) is to be transmitted, a start bit of 1 bit, a parity of 1 bit, and a stop bit of 1 bit are added. That is, the 3-bit data is added to the 1-byte data to be transmitted, and the data has a size of 11 bits (=8+3). However, as long as the UART is employed, the other element may have any bits, for example, the parity bit may have 0 bits, and the stop bit may have 2 bits. In addition, any communication method other than the UART may be employed as a method for the serial communication.

The packet data 350 transmitted to the communication portion 325 is output to the peripheral function portion 321. The peripheral function portion 321 decodes the input packet data 350. When the command 351 is Write, the peripheral function portion 321 writes the designated data to the designated address, and transmits Ack (1 byte) indicating that the Write operation has been completed to the arithmetic operation portion 300. When the command 351 is Read, the peripheral function portion 321 reads the data from the designated address, and transmits a result (2 bytes) of the reading to the arithmetic operation portion 300. After receiving Ack for the Write operation or the result of the Read operation, the arithmetic operation portion 300 transmits the subsequent piece of register data.

In this embodiment, as illustrated in FIG. 3B, a pair of a register address and a piece of register data is stored in advance for each color in each of DMA areas 361 in an address space 360 of the RAM 323 (memory). With this, the DMA 322 is configured to be able to read each of address areas of the DMA area 361 and write the read data to the read register address. Specifically, the DMA areas 361 are a DMA area (Y) 361Y, a DMA area (M) 361M, a DMA area (C) 361C, and a DMA area (K) 361K. A working area 362 is also included in the address space 360 of the RAM 323. For example, a plurality of pairs of the register addresses and the pieces of register data are stored successively from the head of the respective address areas of the DMA area 361. With this configuration, the DMA 322 can read those pairs in succession from the head of the DMA area 361, and write the pieces of data to a plurality of registers in succession. The DMA 322 starts a series of writing processing described above with a trigger that a timer included in the post-stage image processing portion 331 has reached a time-out. This processing is described later with reference to FIG. 5. The DMA 322 reads the data from the RAM 323 and writes the data to the register through the bus. In this embodiment, the bus operates at 20 MHz by the internal clock (not shown), and the data transfer from the RAM 323 to the register, which is performed by the DMA 322, is faster than the serial communication.

When a predetermined piece of register data is to be written to a predetermined register address in the exposure control portion 320 from the CPU 301, the CPU 301 transmits the following packet data 350. That is, the CPU 301 transmits the packet data 350 having "00" designated in the command 351, the register address designated in the address (H) 352 and the address (L) 353, and the piece of register data designated in the data (H) 354 and the data (L) 355. When the pair of a register address and a piece of register data is to be written to the DMA area in the address space 360 within the RAM 323 in the exposure control portion 320 from the CPU 301, the CPU 301 transmits the following packet data 350. First, the CPU 301 transmits the packet data 350 having "00" designated in the command 351, an address within the DMA area designated in the address (H) 352 and the address (L) 353, and the register address designated in the data (H) 354 and the data (L) 355. Then, the CPU 301 transmits the packet data 350 having the subsequent address within the DMA area 361 designated in the address (H) 352 and the address (L) 353 and the register data designated in the data (H) 354 and the data (L) 355. That is, when the pair of the register address and the piece of register data is to be written to the DMA area from the CPU 301, the transmission is performed twice, namely, the transmission of the register address and the transmission of the register data are performed. When a plurality of pairs of register addresses and pieces of register data are to be written, the addresses to be writing destinations within the DMA area 361 may be successively incremented.

Incidentally, a series of steps of processing is performed by the image processing portion 310 as required when image data is input, and the image data is stored in the image buffer portion 315. Therefore, the series of steps of processing can be performed irrespective of (asynchronously with) the arrangement of the photosensitive drums 102 arranged in tandem by being performed so as to precede the latent image formation start timing to store the image data in the image buffer portion 315. Meanwhile, in the exposure control portion 320 positioned downstream of the image buffer portion 315, the image data that has passed through the post-stage image processing portion 331, the PWM generating portion 332, and the laser drive portion 341 are changed into a light beam to irradiate the photosensitive drum 102. Therefore, in order to exactly overlap the latent images of four colors, the processing for each of the M, C, and K colors is performed in consideration of the arrangement of the photosensitive drums 102, namely, performed by setting time differences of the times Td1, Td2, and Td3 determined based on the above-mentioned inter-drum movement time period Td with respect to the Y color.

The image buffer herein refers to a buffer capable of storing image data on Y, M, C, and K for at least one page. However, the exposure control portion 320 may include such a line buffer configured to temporarily hold about several lines of data in units of lines that form the image data in the sub-scanning direction. The exposure control portion 320 of the image forming apparatus 100 according to this embodiment is not limited to the portion configured to perform the image processing step described in this embodiment, and may be configured to perform different processing as long as the processing is performed by setting time differences between the respective colors based on the inter-drum movement time period Td.

[Parameters and Registers]

Figure 4:
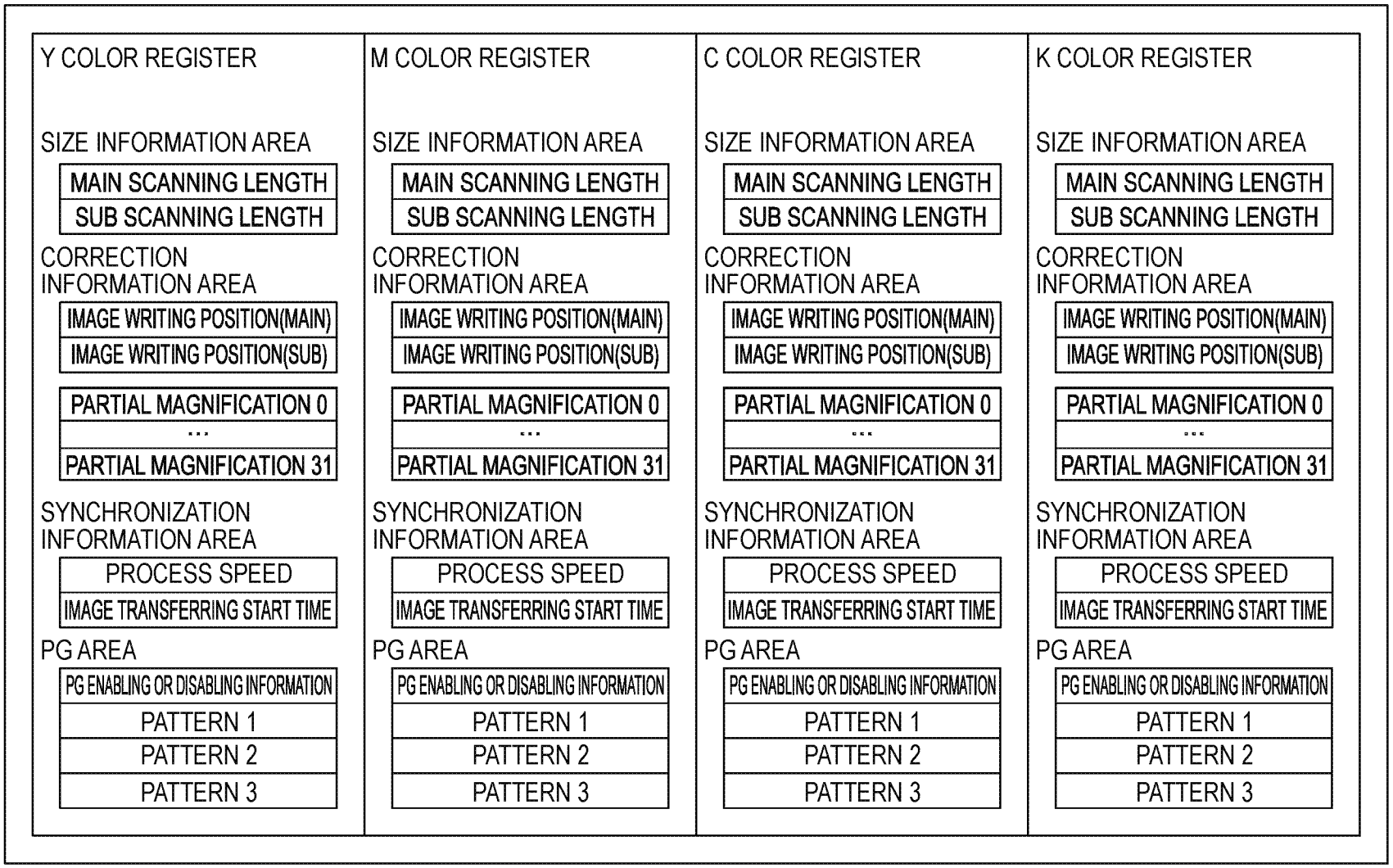
FIG. 4 is a diagram for illustrating an example of parameters to be used for exposure control in this embodiment.

FIG. 4 is a diagram for illustrating an example of registers configured to store parameters required for the operations of the post-stage image processing portion 331 and the PWM generating portion 332 of the exposure control portion 320 in this embodiment. The actual number of parameters (registers) is much larger than that illustrated in FIG. 4, and in this embodiment, there are about, for example, 125 parameters (registers), but the rest of parameters are omitted in FIG. 4. It is to be understood that the registers provided to the exposure control portion 320 are not required to be the same as those illustrated in FIG. 4, and may have more items or less items than those illustrated in FIG. 4. Such parameters as illustrated in FIG. 4 are transmitted from the CPU 301 of the arithmetic operation portion 300 to the exposure control portion 320 as the register data through the communication portions 305 and 325. Those parameters are transmitted in advance before a latent image is formed.

The register data illustrated in FIG. 4 includes data on each color, for example, data on a Y color register. The register data on each color includes, for example, a size information area, a correction information area, synchronization information area, and a PG area. The size information area is an area for storing information on a length in the main scanning direction (hereinafter referred to as "main scanning length") and a length in the sub-scanning direction (hereinafter referred to as "sub-scanning length") of the image data to be printed. The correction information area is an area for storing an image writing start position in the main scanning direction, an image writing start position in the sub-scanning direction, a partial magnification (0 to 31), and other such information. The synchronization information area is an area for storing the process speed, an image transferring start time, and other such information required for synchronization. The PG area is an area for storing PG enabling or disabling information and patterns (1 to 3).

[Latent Image Formation Segments for Respective Colors]

Figure 5:
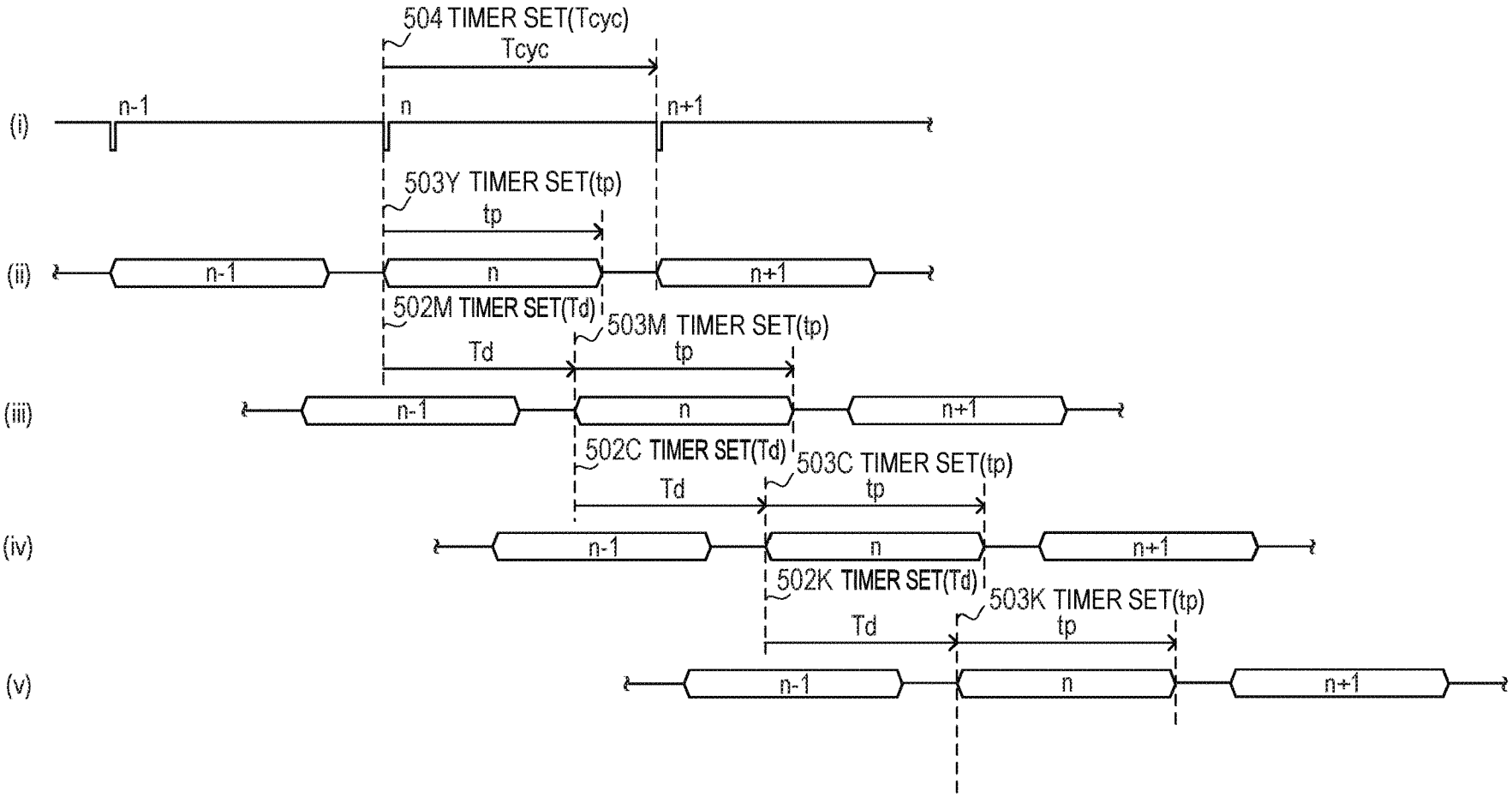
FIG. 5 is a diagram for illustrating how to determine timings to form latent images in this embodiment.

FIG. 5 is a diagram for illustrating how the latent image formation segments for the respective colors are defined in the exposure control portion 320. In parts (i) to (v) of FIG. 5, the same waveforms as those in parts (i) to (v) of FIG. 9C are illustrated. In FIG. 5, how images are continuously formed on three pages n−1, n, and n+1 is illustrated. Part (i) of FIG. 5 is an illustration of the reference timing signal being a reference to be used for starting to form a latent image, and one reference timing signal is generated for one page. The reference timing signal is generated by the CPU 301, and output to the exposure control portion 320 through the hardware signal line 345. Parts (ii) to (v) of FIG. 5 are illustrations of the latent image formation segments for the Y color, the M color, the C color, and the K color, respectively. The following description is mainly given of how the latent image formation segments to be used by the post-stage image processing portion 331 of the exposure control portion 320 are defined by using the n-th page being a predetermined page as the center.

When the reference timing signal for the page "n" is input through the hardware signal line 345, the post-stage image processing portion 331 starts to form the latent image of the Y color as illustrated in part (ii). Specifically, the post-stage image processing portion 331 outputs the vertical synchronization signal 342Y and the horizontal synchronization signal 343Y to the image buffer portion 315. When the reference timing signal for the page "n" is input, the post-stage image processing portion 331 activates the timer configured to measure the lapse of the inter-drum movement time period Td (502M). The inter-drum movement time period Td is stored in advance in the "image transferring start time" being one of the registers for the M color illustrated in FIG. 4. When the timer has reached a time-out (when the inter-drum movement time period Td has elapsed), the post-stage image processing portion 331 starts to form the latent image of the M color as illustrated in part (iii). Specifically, the post-stage image processing portion 331 outputs the vertical synchronization signal 342M and the horizontal synchronization signal 343M to the image buffer portion 315. When the timer has reached a time-out, the post-stage image processing portion 331 activates the timer configured to measure the lapse of the inter-drum movement time period Td (502C). The inter-drum movement time period Td to be used in this case is stored in advance in the "image transferring start time" being one of the registers for the C color illustrated in FIG. 4.

The post-stage image processing portion 331 repeats the same operation to start to form the latent image of the C color and output the vertical synchronization signal 342C and the horizontal synchronization signal 343C to the image buffer portion 315. The post-stage image processing portion 331 activates the timer (502K). The post-stage image processing portion 331 starts to form the latent image of the K color. Specifically, the post-stage image processing portion 331 outputs the vertical synchronization signal 342K and the horizontal synchronization signal 343K to the image buffer portion 315. The post-stage image processing portion 331 includes timers corresponding to a plurality of channels, and is configured to be able to count a plurality of pages in parallel.

The post-stage image processing portion 331 also divides the "sub-scanning length" set in the register illustrated in FIG. 4 by the "process speed", to thereby obtain a time period "tp" required for forming a latent image in the sub-scanning direction (hereinafter referred to as "latent image formation time period "tp" in the sub-scanning direction"). At the start of the formation of a latent image for each color, the post-stage image processing portion 331 starts to measure the latent image formation time period "tp" by the timer (503Y, 503M, 503C, and 503K). The post-stage image processing portion 331 performs the latent image formation by outputting the horizontal synchronization signal 343 and receiving input of the image data from the image buffer portion 315 until the timer reaches a time-out (until the latent image formation time period "tp" is elapsed). A time-out of the timer configured to measure the latent image formation time period "tp" means that the latent image formation segment has been completed, and functions as a trigger to activate the DMA 322. When the latent image formation time period "tp" for each color has reached a time-out of the timer, the DMA 322 reads out the pair of the register address and the piece of register data from the areas for the corresponding color in the DMA areas 361 within the RAM 323. The DMA 322 writes the read register data to the read register address.

In a case of performing the continuous printing, the CPU 301 activates the timer configured to measure the lapse of a cycle time period Tcyc (504) when generating the reference timing signal illustrated in part (i), and when the timer has reached a time-out, generates the reference timing signal for the subsequent page n+1. In this case, the cycle time period Tcyc is a time period obtained based on productivity defined as a product specification. For example, when the printing is performed with the productivity of N pages (Np) per minute (per 60 seconds), the cycle time period Tcyc is calculated by 60/Np. In this embodiment, the productivity is set to, for example, 60 sheets (Np=60) per minute, and the cycle time period Tcyc is one second in this case.

[Timing to Transmit Register Data]

Figure 6A:
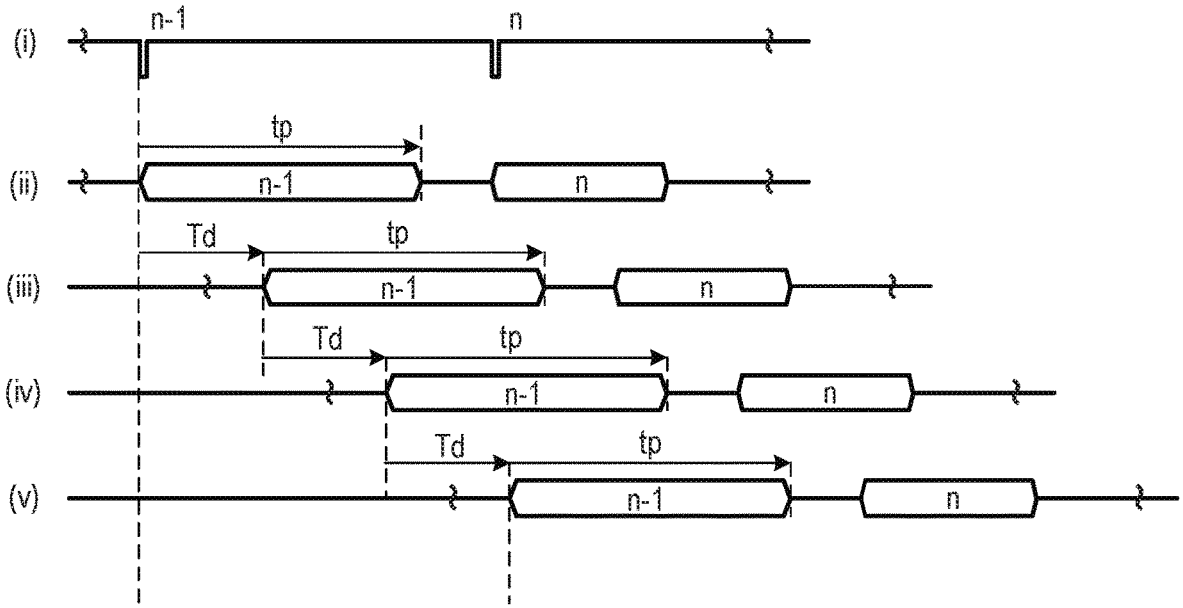
FIG. 6A and FIG. 6B are diagrams for illustrating how to determine timings to transmit the parameters in this embodiment.
Figure 6B:
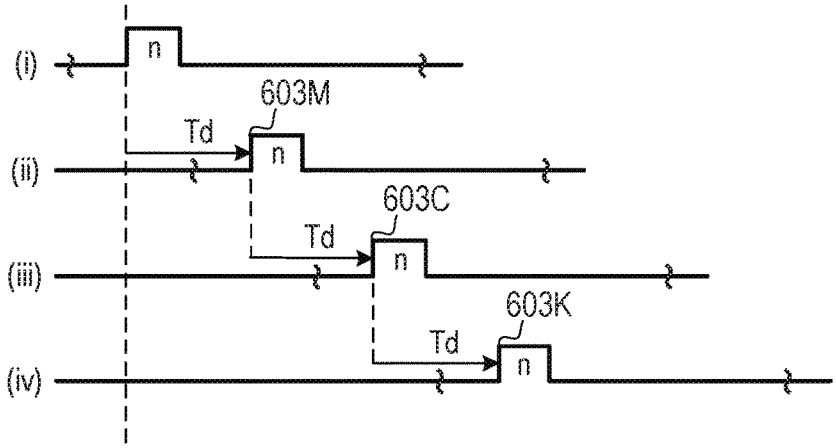

FIG. 6A and FIG. 6B are diagrams for illustrating the timings at which the CPU 301 in the arithmetic operation portion 300 transmits the register data required for the exposure control portion 320 through the communication portion 305. FIG. 6A and FIG. 6B are also diagrams for illustrating the same waveforms as those in FIG. 10A and FIG. 10B, respectively. In this embodiment, the CPU 301 transmits the register data from the communication portion 305 when it is required to change data on registers for determining the operation of the image correction portion 330 of the exposure control portion 320. In this case, the data on the registers for determining the operation of the image correction portion 330 refers to data including a size of a page and other such attributes of the page and correction values of, for example, correction amounts of the image writing start positions in the main scanning direction and the sub-scanning direction and a correction amount of the magnification. The CPU 301 may be configured to transmit the register data required for the exposure control portion 320 for every page irrespective of whether or not the change is required.

In FIG. 6A, a scene in which the page "n" during the continuous printing is different in size from (smaller in size than) that of the page n−1 being a preceding page to be printed prior to the page "n" is illustrated. Part (i) of FIG. 6A is an illustration of the reference timing signal output by the CPU 301. Parts (ii) to (v) are illustrations of the latent image formation segments for the respective colors, which are generated by the exposure control portion 320, and correspond to parts (ii) to (v), respectively, of FIG. 5.

In this embodiment, the CPU 301 transmits the register data required for the subsequent page "n" in synchronization with the timing at which the reference timing signal for the page n−1 is generated. First, when the reference timing signal for the page n−1 is output, the CPU 301 transmits the register data required for the Y color as illustrated in part (i) of FIG. 6B, and at the same time, activates the timer (not shown) built into the CPU 301 to measure the lapse of the inter-drum movement time period Td. As illustrated in part (ii), when the timer has reached a time-out (when the inter-drum movement time period Td has elapsed) (603M), the CPU 301 then transmits the register data required for the M color, and at the same time, further activates the timer to measure the lapse of the inter-drum movement time period Td. As illustrated in part (iii), when the timer has reached a time-out (603C), the CPU 301 then transmits the register data required for the C color, and at the same time, further activates the timer to measure the lapse of the inter-drum movement time period Td. As illustrated in part (iv), when the timer has reached a time-out (603K), the CPU 301 transmits the register data required for the K color. The transmission of the register data does not involve writing the data directly to the register address. As described above, the transmission of the register data is performed on one register twice so as to write the register address and the piece of register data to the areas for the corresponding color in the DMA areas 361 within the RAM 323.

The transmission of the register data may be performed at any time as long as the transmission is completed before the latent image formation start timing for the page "n", but is synchronized with the reference timing signal for the preceding page n−1 in this embodiment for the sake of easy understanding. In another case, the register data for the page "n" may be transmitted at a time point of a page (for example, n−2, n−3 . . . ) much earlier than the page n−1. However, when it is required to transfer pieces of register data to the continuous pages in succession, the earlier pieces of register data are required to be kept stored in the RAM 323 of the exposure control portion 320. Therefore, with such a configuration, it is required to provide a RAM having a larger capacity.

Incidentally, as described above, in this embodiment, 125 registers are provided for one color. This number was calculated by counting the number of settings actually performed in a stage in which development of the image forming apparatus is investigated. An estimated value or other such approximate value may be used instead of an exact number, and in that case, is desired to be multiplied by a coefficient equal to or larger than 1 as a safety factor so as not to fall below the actual number of settings. When the register data is transmitted, communication is performed so as to write the register addresses and the pieces of register data for 125 registers to the DMA area 361, and hence when the number of times of transmission per color is represented by R, the number of times of transmission is obtained as R=250 (=125×2). In this embodiment, the respective drums are arranged with an interval of 90 mm, and a surface speed, namely, a process speed, of the photosensitive drum 102 is set as 240 mm/s. Therefore, the inter-drum movement time period Td expressed by Expression (1-1) is calculated as 375 ms.

As described with reference to FIG. 3A and FIG. 3B, in this embodiment, the transmission of one piece of register data requires 7 bytes (6 bytes for transmission and 1 byte for Ack). In addition, the serial communication in this embodiment is performed through use of the UART, and when one byte (8 bits) of data is transmitted, information having a total of 3 bits including a start bit of 1 bit, a parity of 1 bit, and a stop bit of 1 bit is added, which adds up to 11 bits in total. In view of this, in this embodiment, the transfer speed of the serial communication is set so that the transmission of data corresponding to the number R×2=500 of times of transmission for two colors, namely, the transmission of 500×11 bits, can be performed within a time period of 375 ms. For example, the transfer speed is set to 184.8 Kbps. In this manner, when the number of colors is represented by N, in this embodiment, such a communication speed as to enable the transmission by the number of times expressed as the number (=R×N) of times obtained by multiplying the number R of times of transmission by the number N of colors within the time period of the inter-drum movement time period Td (=1d/v) is set. An increase in number of colors leads to an increase in transfer speed, and hence N is desired to be 2 colors (2) from the viewpoint of measures against noise (2≤N<3). In this embodiment, the transfer speed is fixed at the above-mentioned speed. However, the CPU 301 of the arithmetic operation portion 300 may be configured to switch the transfer speed by determining a required transfer speed depending on the situation of the image forming apparatus 100.

For example, consideration is given to a case in which only thick paper or other such sheet having a large basis weight is set in a sheet storage unit inside the image forming apparatus 100. In general, when printing is to be performed on the thick paper or other such sheet having a large basis weight, an amount of heat required for fixing the toner to the sheet increases. Therefore, it is general to perform printing on thick paper by performing the printing at a process speed lower than in a case of plain paper with an increased amount of heat to be supplied to the sheet per unit time. In this case, for example, when the printing is to be performed on the thick paper at a process speed being half of a process speed at a normal time, the inter-drum movement time period Td becomes twice as long as a time period at the normal time. Therefore, according to this embodiment, the transfer speed in the serial communication may be reduced to half of that at the normal time. Therefore, the configuration can also allow the transfer speed to be changed to a lower speed in such a situation in which the sheets set in the image forming apparatus 100 include only the thick paper.

In addition, for example, the configuration may set a predetermined transfer speed in such a scene as described below. Examples of such scene include a scene in which high productivity is not required for the printing as in service maintenance and a scene in which the transfer speed is to be reduced on purpose in order to examine presence or absence of an influence on an output image due to occurrence of the noise involved in the serial communication. In those scenes, an instruction is issued to the CPU 301 of the arithmetic operation portion 300 through the user interface. With this configuration, a predetermined transfer speed may be set.

[Setting of Transfer Speed]

Figures 7A, 7B:
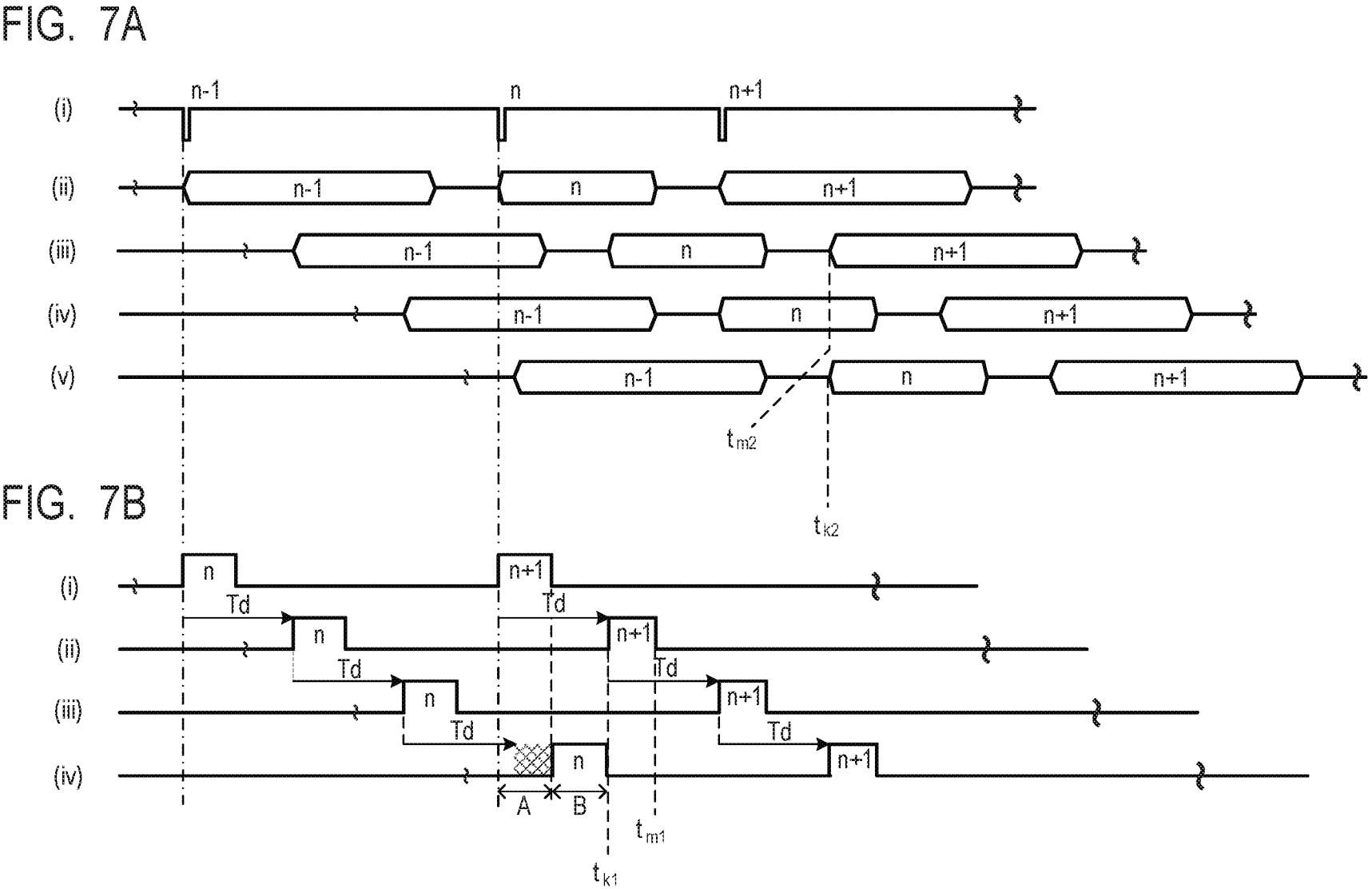
FIG. 7A and FIG. 7B are diagrams for illustrating how the parameters are transmitted in this embodiment.

FIG. 7A and FIG. 7B are diagrams for illustrating how the transfer speed is set so that pieces of register data exactly corresponding to two colors can be transmitted within the inter-drum movement time period Td based on this embodiment. In FIG. 7A, it is illustrated how the page "n" during the continuous printing is different in size from (smaller in size than) those of the preceding page n−1 and the succeeding page n+1. FIG. 7A and FIG. 7B are also diagrams for illustrating waveforms similar to those in FIG. 6A and FIG. 6B, respectively. In such a case, the register data is transmitted before and after the page "n".

In this case, as illustrated in part (i) of FIG. 7B, the transmission of the register data on the Y color for the subsequent page "n" is requested in synchronization with the reference timing signal for the page n−1. In addition, as illustrated in part (ii) of FIG. 7B, the transmission of the register data on the M color is requested with the interval of the inter-drum movement time period Td from the timing at which the transmission of the register data on the Y color is requested. In addition, as illustrated in part (iii) of FIG. 7B, the transmission of the register data on the C color is requested with the interval of the inter-drum movement time period Td from the timing at which the transmission of the register data on the M color is requested. In addition, as illustrated in part (iv) of FIG. 7B, the transmission of the register data on the K color is requested with the interval of the inter-drum movement time period Td from the timing at which the transmission of the register data on the C color is requested.

In the same manner, the pieces of register data for the subsequent page n+1 are transferred with the intervals of the inter-drum movement time period Td in synchronization with the reference timing signal for the page "n" (parts (i) to (iv) of FIG. 7B). In this case, the transmission of the register data on the Y color for the page n+1 illustrated in part (i) is started immediately before the timing to start to transfer the register data on the K color for the page "n" illustrated in part (iv). That is, the transmission segments of the pieces of register data do not overlap with each other between different colors for the same page, but overlap with each other between different colors for different pages. Therefore, the transmission of the register data on the K color for the page "n" is started with a delay corresponding to a segment indicated by the hatched portion in part (iv) of FIG. 7B.

However, according to this embodiment, even when being added up, a transmission time period (segment A) of the register data on the Y color for the page n+1 and a transmission time period (segment B) of the register data on the K color for the page "n" fall within the inter-drum movement time period Td (A+B≤Td). Therefore, there is no delay in timing to start to subsequently transmit the register data on the M color for the page n+1. Specifically, a transmission completion timing ($t_{k1}$) of the register data on the K color for the page "n", which has caused the delay, temporally precedes a latent image formation start timing ($t_{k2}$) of the K color for the page "n". In addition, a transmission completion timing ($t_{m1}$) of the register data on the M color for the page n+1, which has not caused a delay, temporally precedes the latent image formation start timing ($t_{m2}$) of the M color for the page n+1. That is, such a case as illustrated in FIG. 11B in which delays are accumulated does not occur, and a situation in which the setting of a required register is yet to be completed can be avoided by a minimum transfer speed.

As described above, according to at least one embodiment, an image failure ascribable to a data transfer timing can be prevented.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-108719, filed Jun. 6, 2018, which is hereby incorporated by reference herein in its entirety.

What is claimed is:

1. An image forming apparatus of a tandem type, the image forming apparatus comprising:

a first photosensitive drum capable of rotating at a predetermined rotation speed and a second photosensitive drum capable of rotating at the predetermined rotation speed, the first photosensitive drum and the second photosensitive drum being located at a predetermined interval;

a first light source configured to emit light for exposing the first photosensitive drum and a second light source configured to emit light for exposing the second photosensitive drum;

a generating unit configured to generate a drive signal for causing each of the first light source and the second light source to perform one of turning on of light and turning off of light based on image data; and an output transfer unit configured to output a parameter for generating the drive signal, and to transfer the parameter to the generating unit, wherein a transfer speed of the parameter transferring from the output transfer unit to the generating unit is set so that a sum of a first transfer time of transferring to the generating unit the drive signal of the parameter for driving the first light source and a second transfer time of transferring to the generating unit the drive signal of the parameter for driving the second light source is within a time period calculated from the predetermined interval and the predetermined rotation speed.

2. The image forming apparatus according to claim 1, wherein the output transfer unit is configured to output the parameter to the generating unit through serial communication.

3. The image forming apparatus according to claim 1, wherein the output transfer unit is configured to output a reference signal, which is a reference to be used for outputting the image data, to the generating unit, and output the parameter to the generating unit based on the reference signal.

4. The image forming apparatus according to claim 3, wherein the output transfer unit is configured to output, when printing is continuously performed, the parameter for printing a predetermined page in accordance with the outputting of the reference signal for a preceding page to be printed prior to the predetermined page.

5. The image forming apparatus according to claim 3, wherein the output transfer unit is configured to output the reference signal based on productivity defined for the image forming apparatus.

6. The image forming apparatus according to claim 4, wherein the generating unit includes:

a register configured to store the parameter;

a memory configured to temporarily store the parameter; and a bus configured to connect the register and the memory to each other, and transfer data at a speed faster than the transfer speed, wherein the output transfer unit is configured to store, in the memory, the parameter for printing the predetermined page in accordance with the outputting of the reference signal for the preceding page, and wherein the generating unit is configured to transfer the parameter for printing the predetermined page stored in the memory to the register through the bus when a latent image for the preceding page has finished forming.

7. The image forming apparatus according to claim 1, wherein the parameter includes a value relating to information of a main scanning length and a sub-scanning length of data of an image to be printed.

8. The image forming apparatus according to claim 1, wherein the parameter includes a value relating to information of an image writing start position in a main scanning direction.

* * * * *